US006789969B2

(12) United States Patent
Hirabayashi et al.

(10) Patent No.: US 6,789,969 B2
(45) Date of Patent: Sep. 14, 2004

(54) PRINTER

(75) Inventors: Kenichi Hirabayashi, Suwa (JP); Kazuya Oshida, Suwa (JP); Norio Nagata, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/178,446

(22) Filed: Jun. 21, 2002

(65) Prior Publication Data

US 2003/0002908 A1 Jan. 2, 2003

(30) Foreign Application Priority Data

Jun. 25, 2001 (JP) ..... 2001-191871
Jun. 25, 2001 (JP) ..... 2001-191875
Oct. 16, 2001 (JP) ..... 2001-318595

(51) Int. Cl.[7] ..... B41J 29/02
(52) U.S. Cl. ..... 400/693; 400/589; 400/605; 400/613
(58) Field of Search ..... 400/613, 613.1, 400/589, 605, 611, 693

(56) References Cited

U.S. PATENT DOCUMENTS 4,641,980 A 2/1987 Matsumoto et al.
4,729,681 A 3/1988 Moser
4,909,645 A 3/1990 Sudo et al.
5,219,236 A 6/1993 Kamimura et al.
5,230,576 A 7/1993 Sone
5,528,273 A 6/1996 Takizawa et al.
5,528,278 A 6/1996 Takizawa et al.
5,579,043 A 11/1996 Patry
5,631,690 A 5/1997 Tashiro et al.
5,672,020 A 9/1997 Leonard et al.
5,833,380 A 11/1998 Hosomi et al.
5,887,999 A 3/1999 Smith et al.
5,993,093 A 11/1999 Schoennauer et al.
6,022,158 A 2/2000 Nakayama et al.
6,102,590 A 8/2000 Harris et al.
6,155,730 A 12/2000 Nakayama et al.
6,250,823 B1 * 6/2001 Harris et al. ..... 400/56
6,345,782 B1 * 2/2002 Nakayama et al. ..... 242/564.4
6,361,231 B1 3/2002 Sato et al.
6,491,459 B2 * 12/2002 Hosomi ..... 400/613

FOREIGN PATENT DOCUMENTS

EP 0 764 585 A1 3/1997
JP 58-29453 8/1981
JP 63-98451 4/1988
JP 1-97670 4/1989
JP 3-258575 11/1991
JP 3-275375 12/1991
JP 4-120051 10/1992
JP 5-147291 6/1993
JP 8-142445 6/1996

* cited by examiner

*Primary Examiner*—Andrew H. Hirshfeld
*Assistant Examiner*—Dave A. Ghatt
(74) *Attorney, Agent, or Firm*—Rosalio Haro

(57) ABSTRACT

A printer retracts the platen and transportation rollers when a cover is opened while avoiding interference with parts inside the printer without hindering smooth opening and closing of the cover, increasing printer size, or requiring a large space around the printer. The printer 10 has a frame (cover 12 and unit frame 27) having a paper storage unit 13 for storing a paper roll P1, a cover 28 for opening and closing an opening 26 to the paper storage unit 13, a print head 16 for printing on the roll paper from the paper roll P1, a movable platen 17 freely rotatably coupled to the cover 28 for guiding the back of the roll paper at a proximal position opposite the print head 16, and an abutment 35 for engaging a engagement lever 36 and rotating the movable platen 17 in a contrary direction in conjunction with opening and closing the cover 28. When the cover 28 opens, the abutment 35 rotates the free end side of the movable platen 17 away from the proximal position opposite the print head 16, and when the cover 28 closes the abutment 35 rotates the free end of the movable platen 17 toward the proximal opposite position.

20 Claims, 26 Drawing Sheets

PRINTER

BACKGROUND OF THE INVENTION

1. Field of the Invention

The present invention relates to a printer that prints to a continuous sheet medium, and relates more particularly to a printer having a mechanism for retracting a platen from a proximal position opposite a print head in conjunction with a cover opening operation. This invention also relates to a printer for printing to continuous sheet media and single-sheet media, and relates more particularly to a printer having a diversion unit for diverting continuous sheet and single sheet media.

2. Description of the Related Art

Printers having a storage unit for internally storing a paper roll as a type of continuous sheet print medium and pulling the roll paper (i.e. paper strip) off the paper roll in the storage unit for printing are known. Printers of this type have an opening part that is opened and closed by a cover. A paper roll is typically replaced and the inside of the printer is maintained through this opening part. When a paper roll is replaced, the paper must be pulled manually from the storage unit and set into the paper transportation path, and it is therefore preferable to locate the platen and transportation rollers forming one side of the paper transportation path on the side of the cover that opens and closes the opening to the storage unit. This configuration assures that the roll paper (i.e. paper strip) can be easily aligned in the paper transportation path when the cover is opened to change the paper roll because the platen and transportation rollers retract with the cover and thus open the paper transportation path.

Printers that use a common print head to print on both continuous sheet media and single sheet forms have also become common. Printers of this type can print on single sheet forms for issuing receipts, invoices, tickets, coupons, and other such forms, and are widely used in supermarkets and retail stores. Printers of this type preferably guide both continuous sheet media and single sheet media to a common printing position, and then eject the different types of media from different exit openings after being printed. A diversion unit for diverting continuous sheet media and single sheet media to different exit paths is therefore required at a position downstream from the print head.

The platen cannot be retracted with the cover in a printer that does not have a space in the platen retraction movement direction, and the diversion unit obstructs the platen retraction movement in printers that can print on both continuous sheet media and single sheet forms. The diversion unit can also interfere with opening and closing the cover. In addition to the diversion unit obstructing smooth opening and closing of the cover in this case, damage to the diversion unit or parts on the cover side could also result.

To address this problem JP-A-2000-118064 proposes retracting the platen in conjunction with the cover while avoiding interference with the paper exit diversion unit and other parts inside the printer by adding an operation for retracting the platen from an operative position (a position closely opposite the print head) in conjunction with a cover opening action and advancing the platen to the operative position in conjunction with a cover closing action. JP-A-2000-118064 achieves this action by using a large slide mechanism in order to retract the platen from the operative position opposite the print head, and thus presents problems such as described below.

(1) The sliding resistance of the slide mechanism could obstruct smooth opening and closing of the cover.

(2) Inclusion of a large slide mechanism tends to increase the printer size.

(3) Because the slide mechanism is retracted from above the paper roll storage unit, a wide space is needed around the printer in order to open the cover wide enough to retract the slide mechanism.

SUMMARY OF THE INVENTION

The present invention is directed to solving these problems and an object of the invention is to provide a printer which can retract the platen and transportation rollers while avoiding interference with internal printer parts when opening the cover, does not obstruct smooth opening and closing of the cover, invite an increase in printer size, or require a wide space around the printer, and can accurately position the movable platen to prevent print defects and form transportation problems.

A further object of the invention is to provide a printer having a diversion unit at a position downstream from the print head for diverting continuous sheet media and single sheet media. More particularly, this printer automatically retracts the diversion unit during a cover opening operation to a position where the diversion unit will not interfere with cover opening and closing, thereby enabling a smooth cover opening operation and preventing damage to the diversion unit. This printer can also improve the operability of the cover opening operation by releasing the cover lock and retracting the diversion unit as a result of linear operation of the cover release button.

To achieve this object a printer according to the present invention has a housing (including cover and unit frame) with a paper storage unit for holding a continuous sheet medium, a cover for opening and closing an opening to the paper storage unit, a print head for printing on the continuous sheet medium pulled out from the paper storage unit, a platen pivotally supported on the cover and movable between an inoperative and an operative position relative to the cover for guiding, in its operative position, a back surface of the continuous sheet medium at a position opposite the print head, and an abutment for engaging a fixed end side of the platen and rotating the free end side of the platen in conjunction with opening and closing the cover. It is therefore possible to retract the platen together with the cover without interfering with other internal parts of the printer when the cover is opened, and unlike a conventional sliding mechanism used to advance and retract the platen, the configuration of the present invention does not interfere with smooth opening and closing of the cover, invite an increase in printer size, or require a wide space around the printer.

Furthermore, a first movable transportation roller is preferably disposed at the free end side of the platen for transporting the continuous sheet medium between the first movable transportation roller and a first fixed transportation roller disposed on the frame side. In this case the continuous sheet medium can be easily aligned to the paper transportation path when the cover is closed.

Yet further preferably, a second movable transportation roller is disposed at the fixed end side of the platen for transporting the continuous sheet medium between the second movable transportation roller and a second fixed transportation roller disposed on the frame side. Continuous sheet medium transportation problems can thus be prevented by transporting the paper with a pair of first and second transportation rollers. In addition, by holding the continuous sheet medium with the first and second movable transportation rollers when the cover is closed, appropriate tension can be applied to the continuous sheet medium and printing defects caused by slack in the continuous sheet medium can be prevented.

Yet further preferably, the first movable transportation roller contacts the first fixed transportation roller on the upstream side of the print head after the second movable transportation roller contacts the second fixed transportation roller on the downstream side of the print head when the cover is operated to close. With this configuration the first and second movable transportation rollers apply pressure to the continuous sheet medium at different times, and as a result problems such as excessive force acting on the continuous sheet medium and the transportation rollers, and applying pressure to the continuous sheet medium while there is slack in the paper, can be avoided.

Further preferably, a positioning guide part is disposed on the free end side of the platen for guiding the platen relative to the frame when the cover is operated to close. This accurately positions the platen and thus prevents printing defects and transportation problems.

Yet further preferably, the abutment substantially stops rotation of the platen near the fully closed position of the cover, and so as to allow the positioning guide part engage with a fixed guide pin on the frame side. The movable platen can thus be positioned accurately.

The guiding direction of the positioning guide part is further preferably substantially perpendicular to the direction in which the platen escapes from the print head. Movement of the platen away from the print head is thus reliably restricted by the positioning guide parts, and printing defects caused by the platen separating from the print head can be prevented.

Furthermore, because the guiding direction of the positioning guide part is substantially perpendicular to a tangent of the first movable transportation roller and the first fixed transportation roller, the first movable transportation roller can be accurately positioned to the first fixed transportation roller, and paper transportation problems due to an offset in the positions of the transportation rollers, can be prevented.

Yet further preferably, a first movable transportation roller is disposed on the free end side of the platen for transporting the continuous sheet medium between the first movable transportation roller and a first fixed transportation roller on the frame side. The support axis (shaft) of the first movable transportation roller is also positioned on the print head side of an imaginary line passing through the center of the platen and the center of first fixed transportation roller as seen in a side view. It is therefore possible to press and position the platen to the print head using the first fixed transportation roller and first movable transportation roller. The number of parts can therefore be reduced and the structure simplified compared with a configuration using special platen presser or platen positioning members.

Yet further preferably, accommodating means allowing the first movable transportation roller to pass over the first fixed transportation roller in conjunction with opening and closing the cover are provided. This reduces the load of the first movable transportation roller as it moves over the first fixed transportation roller, thus avoids deformation of or damage to members when the movable transportation roller rides over the fixed transportation roller, and avoids problems interfering with smooth opening and closing of the cover.

In one embodiment, the print head can print to continuous sheet media and a single-sheet media, and in this case the printer additionally has a diversion unit disposed at a position downstream of the print head on the frame side for diverting the continuous sheet medium and single-sheet form P2 to respective paths. The diversion unit can be retracted to a position not interfering with the opening and closing of the cover. In other words, while the diversion unit for diverting the continuous sheet medium and single-sheet form to separate exit paths is disposed at a position downstream of the print head, the diversion unit can be automatically retracted when the cover is opened or closed to a position not interfering with opening and closing the cover. Interference between the diversion unit and platen is therefore reliably avoided, the cover can be smoothly opened, and damage to the diversion unit can be avoided.

Yet further preferably the abutment is positioned near the diversion unit. In other words, by disposing the abutment near the diversion unit, which is prevented from interfering with the platen, the platen can be made as small as possible and the abutment is prevented from interfering with replacing the continuous sheet medium.

Furthermore, by disposing the second fixed transportation roller at the diversion unit and transporting the continuous sheet medium on the downstream side of the print head, slack can be prevented in the continuous sheet medium, and the medium can be reliably transported to and past the diversion unit. In addition, because the diversion unit is also used as the support member for the second fixed transportation roller, the part count can be reduced and the construction can be simplified.

Furthermore, the diversion unit is configured to pivot freely in an advancing-retracting direction relative to the continuous sheet medium transportation path or second movable transportation roller, and is urged by a presser spring in the advancing direction. The diversion unit can therefore be smoothly retracted when there is contact with the platen, and pressure can be applied reliably to the paper due to the urging force of the presser spring.

Yet further, because the diversion unit has a fixed knife for cutting the continuous sheet medium, the diversion unit is also used as the support member for the fixed knife. This further reduces the part count and simplifies the structure.

Further preferably, the printer has a cover release button disposed on the frame side and operated in a straight line, and a cover locking mechanism for locking the cover in a closed position. The cover locking mechanism enables the cover to be opened when the cover release button is operated, and thus enables the diversion unit to move to the retracted side.

The cover locking mechanism has lock pins disposed on the frame side; lock levers rotatably disposed at the frame side for engaging and releasing the lock pins; and a lock release lever rotatably disposed at the frame side. When the cover release button is operated the lock release lever moves the lock levers to disengage and release the lock pins, and move the diversion unit to the retracted side. That is, while the cover release button travels in a straight line it moves the lock levers and diversion unit by way of a pivoting lock release lever, thereby reducing the force needed to operate the cover release button and further improving the operability of the cover opening operation.

Yet further preferably, the lock release lever has a first lever part linked to the cover release button; a second lever part linked to the lock levers and the diversion unit; and a connecting part integrally linking the first and second lever parts. The first and second lever parts, are pivotally supported. This configuration increases lock release lever strength, enables the lock release lever to operate smoothly, and thus further improves the operability of the cover opening operation.

Yet further preferably, a lock release lever support part (lock release lever support member and side frame) supporting the lock release lever to pivot freely comprises a rotation support part enabling attaching the lock release lever from a lateral direction outside the normal rotation range; and a stopper limiting lateral movement of the lock release lever in the normal rotation range. Rotation of the lock release lever to outside the normal rotation range is limited by the cover release button. A special member for limiting lateral movement of the lock release lever is thus unnecessary, and the part count and the number of assembly steps can therefore be reduced and the structure can be simplified.

Further preferably, first or second lever part has a notched part contiguous to the pivot hole, and the rotation support part has a narrow part to which the notched part fits and a pivot shaft part protruding horizontally from the narrow part. The pivot hole can be fit to the pivot shaft part when the notched part is fit to the narrow part. It is therefore possible to install the lock release lever to the rotation support part using a simple configuration having a notched part formed in the lock release lever and a narrow part formed to the rotation support part.

Other objects and attainments together with a fuller understanding of the invention will become apparent and appreciated by referring to the following description of a preferred embodiment taken in conjunction with the accompanying drawings.

BRIEF DESCRIPTION OF THE DRAWINGS

In the drawings wherein like reference symbols refer to like parts.

DESCRIPTION OF THE PREFERRED EMBODIMENTS

1. Overall Configuration of the Printer

Figure 1:
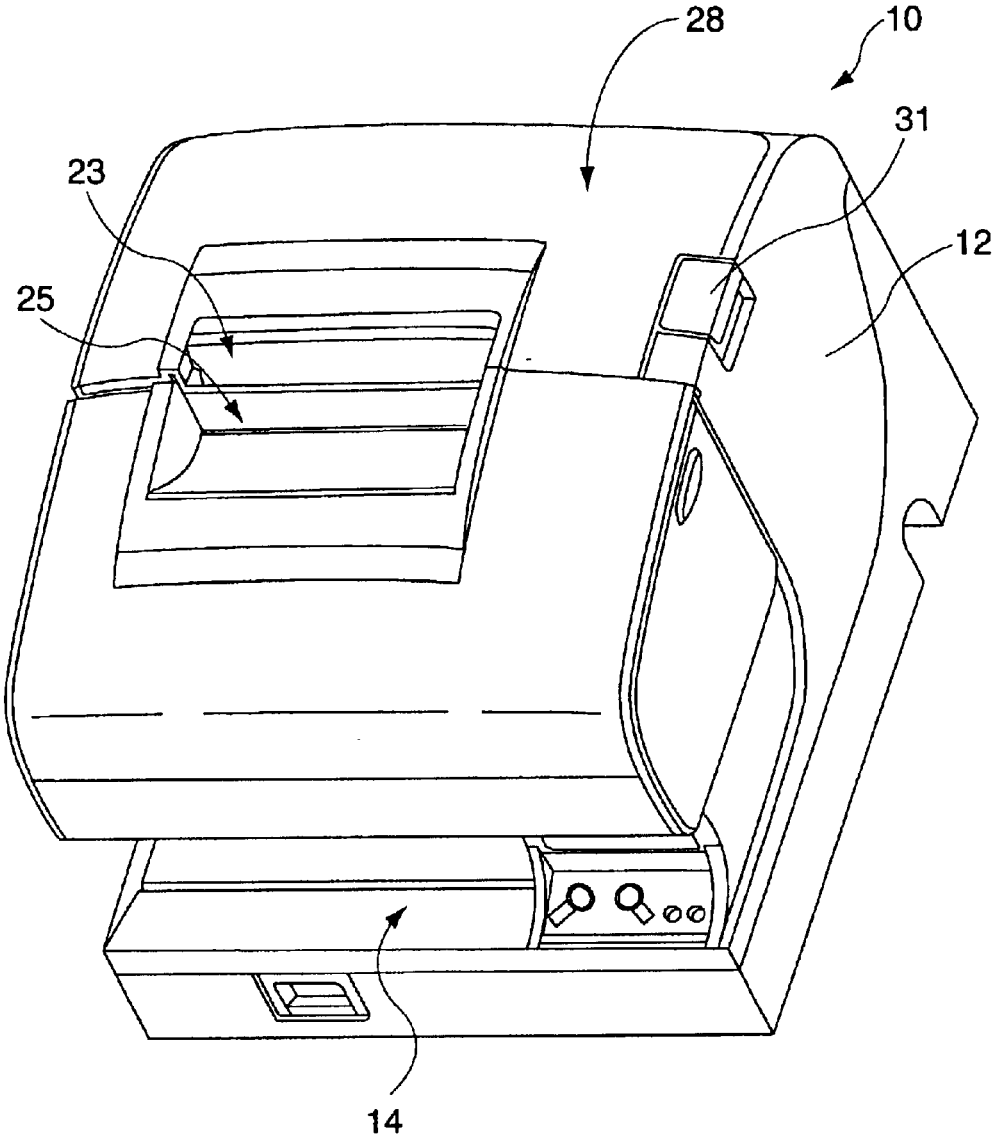
FIG. 1 is a perspective view of a printer according to a preferred embodiment of the invention with the cover closed.
Figure 2:
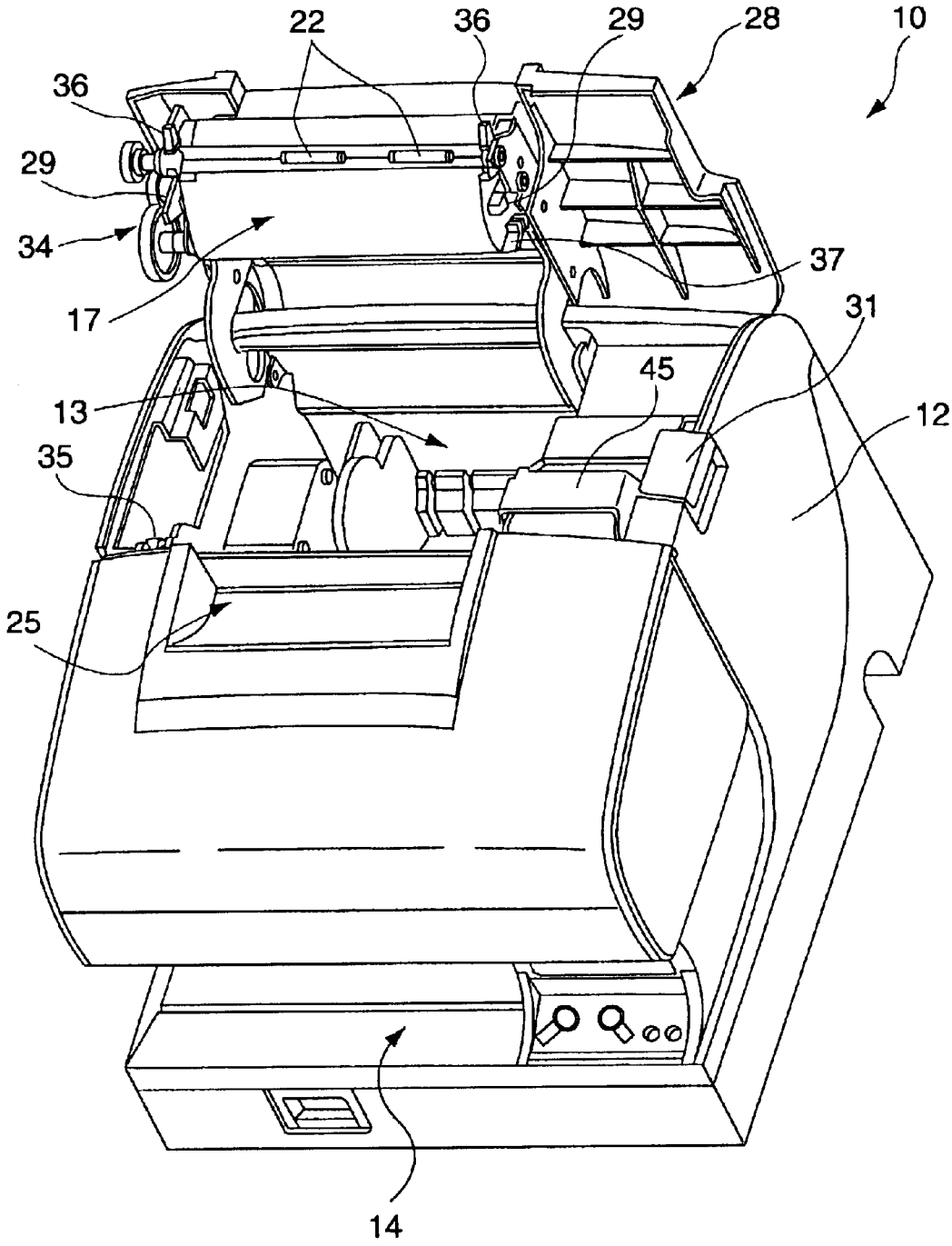
FIG. 2 is a perspective view of the printer with the cover open.
Figure 3:
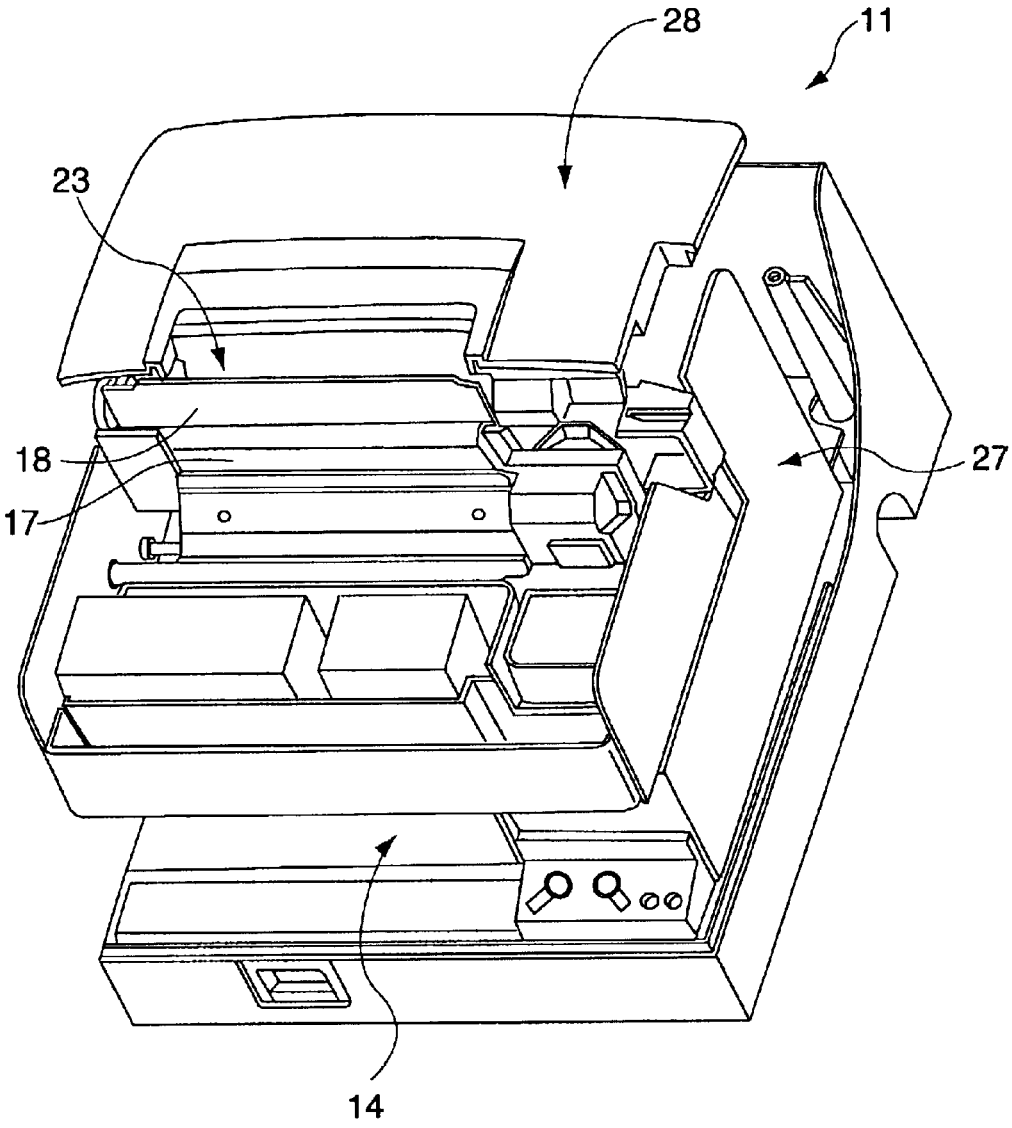
FIG. 3 is a perspective view showing the printer unit cover closed.
Figure 4:
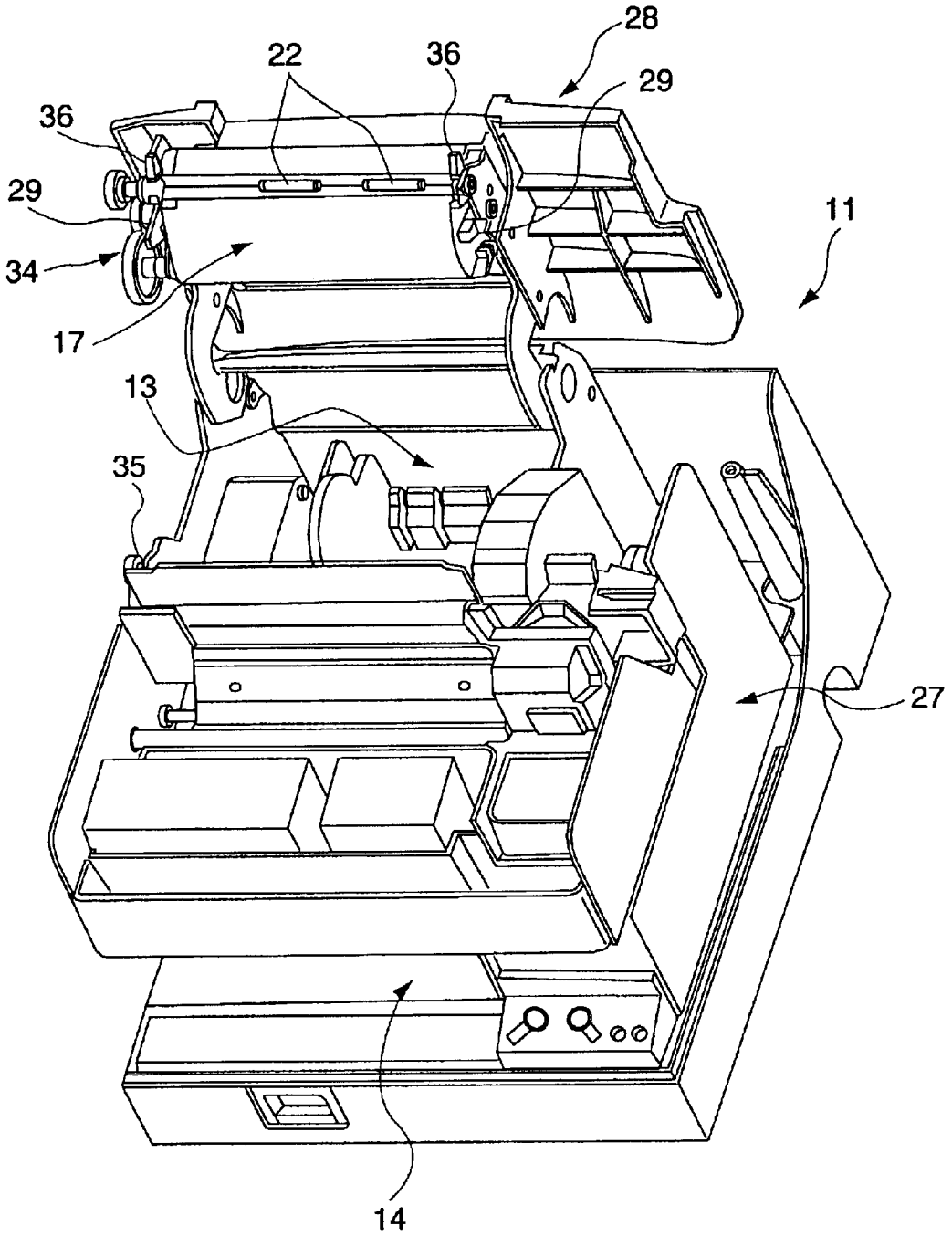
FIG. 4 is a perspective view showing the printer unit cover open.
Figure 5:
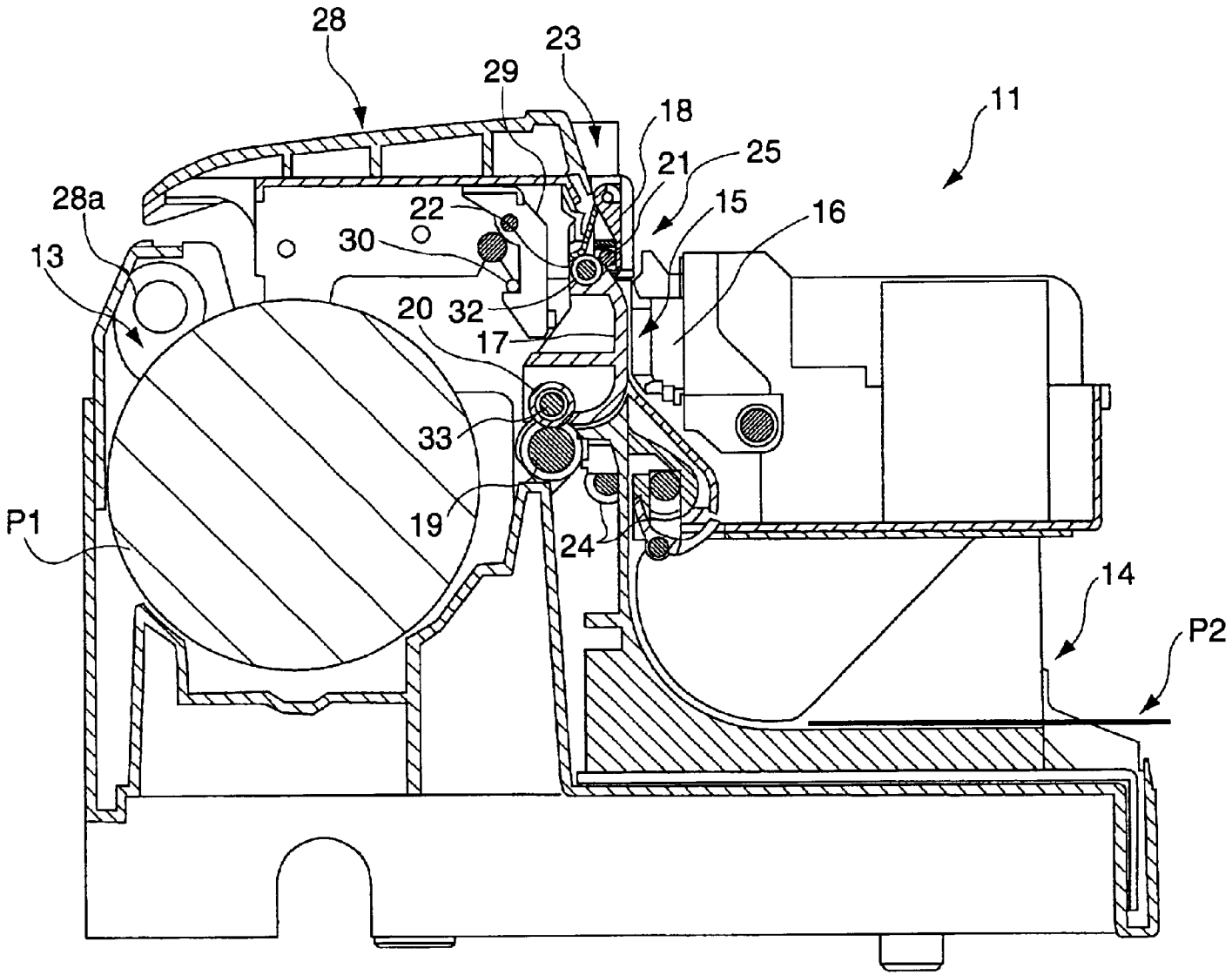
FIG. 5 is a side section view of the printer unit.

A preferred embodiment of the present invention is described below with reference to the accompanying figures wherein FIG. 1 is a perspective view of a printer according to a preferred embodiment of the invention with the cover closed, FIG. 2 is a perspective view of the printer with the cover open, FIG. 3 is a perspective view showing the printer unit cover closed, FIG. 4 is a perspective view showing the printer unit cover open, and FIG. 5 is a side section view of the printer unit.

As will be known from these figures, the printer 10 comprises a printer unit 11 with a cover 12 (a housing member). The printer 10 has a paper storage unit 13 for storing a paper roll P1 (a continuous sheet medium), and a form insertion opening 14 for inserting a single-sheet form P2 (single sheet medium). The roll paper transportation path and the single-sheet transportation path are configured to transport roll paper, which is pulled out from the paper roll P1 in storage unit 13, and transport a single-sheet form P2, which inserted into the form insertion opening 14, to and past a common printing position 15.

A print head 16 and a movable platen 17, in its operating position, are disposed opposite each other and define the printing position 15 between them. Downstream therefrom is disposed a diversion unit 18 for diverting the paper roll P1 and single-sheet form P2 to corresponding ejection paths.

The print head 16 can be, for example, an inkjet print head mounted on a carriage (not shown in the figure) that travels bidirectionally widthwise to the paper transportation path for dot matrix printing on the surface of roll paper or single-sheet form P2 backed by the movable platen 17. Roll paper pulled out from the paper roll P1 passes between a first fixed transportation roller 19 (drive roller) and first movable transportation roller 20 (pinch roller) to the printing position 15, and passes between a second fixed transportation roller 21 (pinch roller) and second movable transportation roller 22 (drive roller) and by a cutter mechanism 48 (further described below) behind the diversion unit 18 before being ejected from paper roll exit 23. A single-sheet form P2 inserted into form insertion opening 14 passes between a pair of single-sheet transportation rollers 24 to the printing position 15 on the downstream side of rollers 24, and passes in front of the diversion unit 18 to exit from the single-sheet form exit 25.

An opening 26 (see FIG. 6) is formed above the paper storage unit 13, and the paper roll P1 is replaced through this opening 26. The opening 26 is opened and closed by a cover 28 hinged at the back of a unit frame 27 (a housing member) so as to rotate freely up and down about a pivot axis that extend substantially in parallel to axis of the paper roll P1 and the stroke of the print head 16. The cover 28 is supported to rotate freely up and down pivoting on burring parts 28*a* fit into pivot holes (not shown in the figure) in the side frames 46 of the unit frame 27.

A pair of right and left lock levers 29 is disposed freely rotatable back and forth on the cover 28 about a pivot axis that extends in parallel to that of the cover 28. When the cover 28 is closed from the open position and reaches the closed position, the lock levers 29 engage lock pins 30 disposed on the unit frame 27 and thus automatically lock the cover 28 in its closed position. To open the cover 28 a cover release button 31 further described below is operated to disengage the lock levers 29 and unlock the cover 28.

2. Platen Configuration

One end of the movable platen 17 is pivotally supported at the free end part of the cover 28 by way of platen support shaft 32 that extends in parallel to the pivot axis of the cover 29. The first movable transportation roller 20 is disposed on a roller shaft 33 at the free end side of the movable platen 17, and the second movable transportation roller 22 is disposed on platen support shaft 32 at the fixed (supported) end side. A transfer gear mechanism 34 is disposed at one side of the movable platen 17.

The second movable transportation roller 22, which is the drive roller, is linked to the transportation motor (not shown in the figure) through transfer gear mechanism 34 when the cover 28 is fully closed, and is thus rotationally driven by power from the transportation motor.

The movable platen 17 is urged to the bottom side of the cover 28 by an elastic retraction mechanism 60 (see FIG. 15), i.e., a tension coil spring stretched between a side of the movable platen 17 and the bottom side of the cover 28, so that when the cover 28 is open the urging force of the elastic retraction mechanism 60 holds the movable platen 17 to the bottom of the cover 28 (in the inoperative position of the platen). Note the bottom of the cover is that part that faces the paper storage unit 13 when the cover is closed.

3. Platen Operation

An abutment 35 for rotating movable platen 17 between it inoperative and operative positions in conjunction with the opening and closing motion of the cover 28 is disposed proximally above the diversion unit 18 on the unit frame 27 side. The abutment 35 is engaged by the pair of right and left engagement levers 36 protruding at the fixed end side of the movable platen 17 to swing the movable platen 17 between its two positions relative to the cover. The basic operation of movable platen 17 is further described below with reference to FIGS. 6 to 11.

Figure 6:
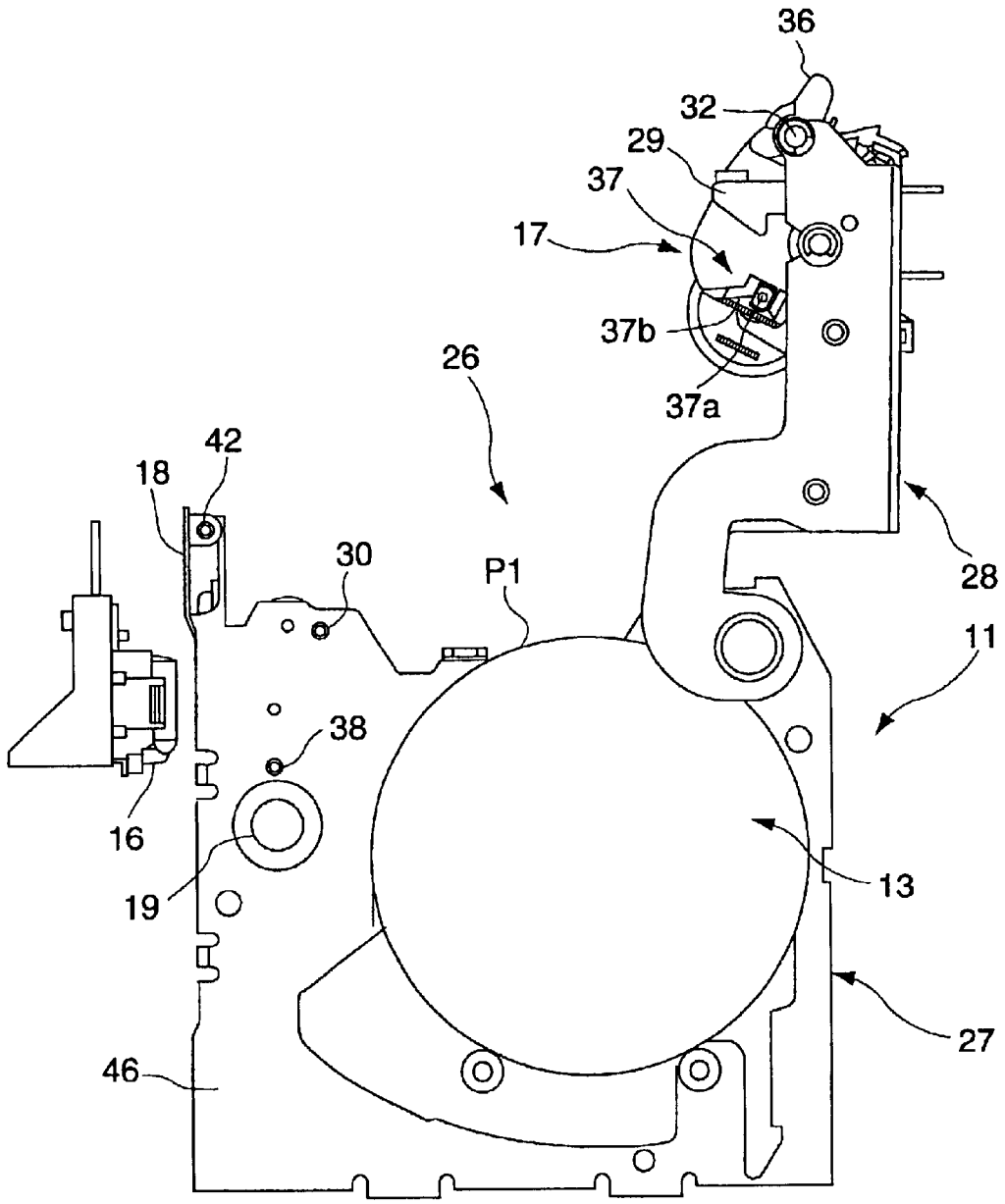
FIG. 6 is a side view of the printer unit when the cover is in the full open position.

FIG. 6 is a side view of the printer unit when the cover 28 is in the full open position. As shown in FIG. 6, the movable platen 17 is held in a position along the bottom of the cover 28 by the urging force of the elastic retraction mechanism 60 when the cover 28 is fully open and a wide space is open above the paper storage unit 13. One side of the roll paper transportation path is opened by retracting the movable platen 17, first movable transportation roller 20, and second movable transportation roller 22 in conjunction with the cover 28. When the cover 28 is thus open, paper roll P1 can be loaded into the paper storage unit 13 and the end of the paper roll P1 can be fed into the roll paper transportation path from the paper storage unit 13.

Figure 7:
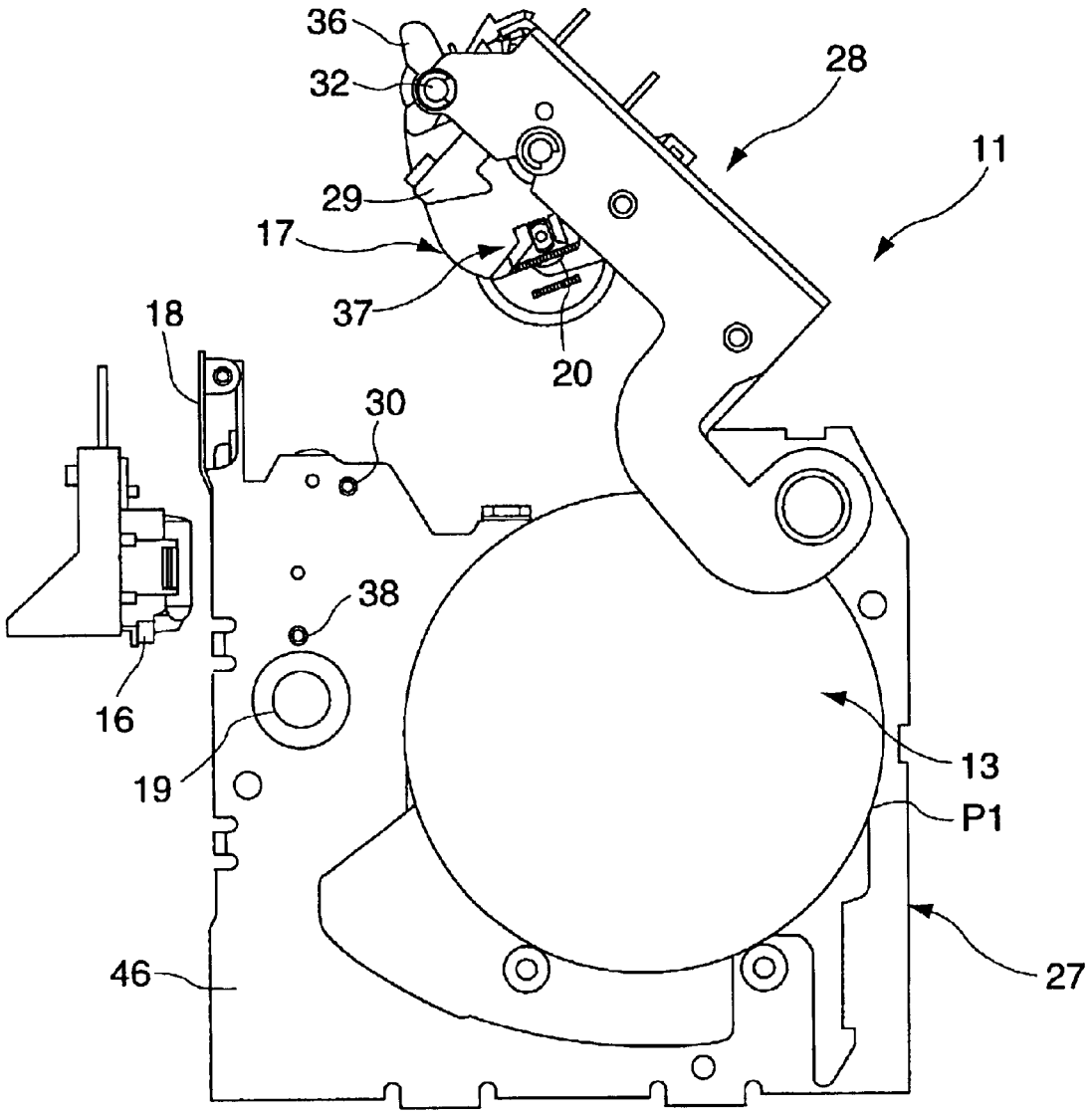
FIG. 7 is a side view of the printer unit when the cover is in the half open position.
Figure 8:
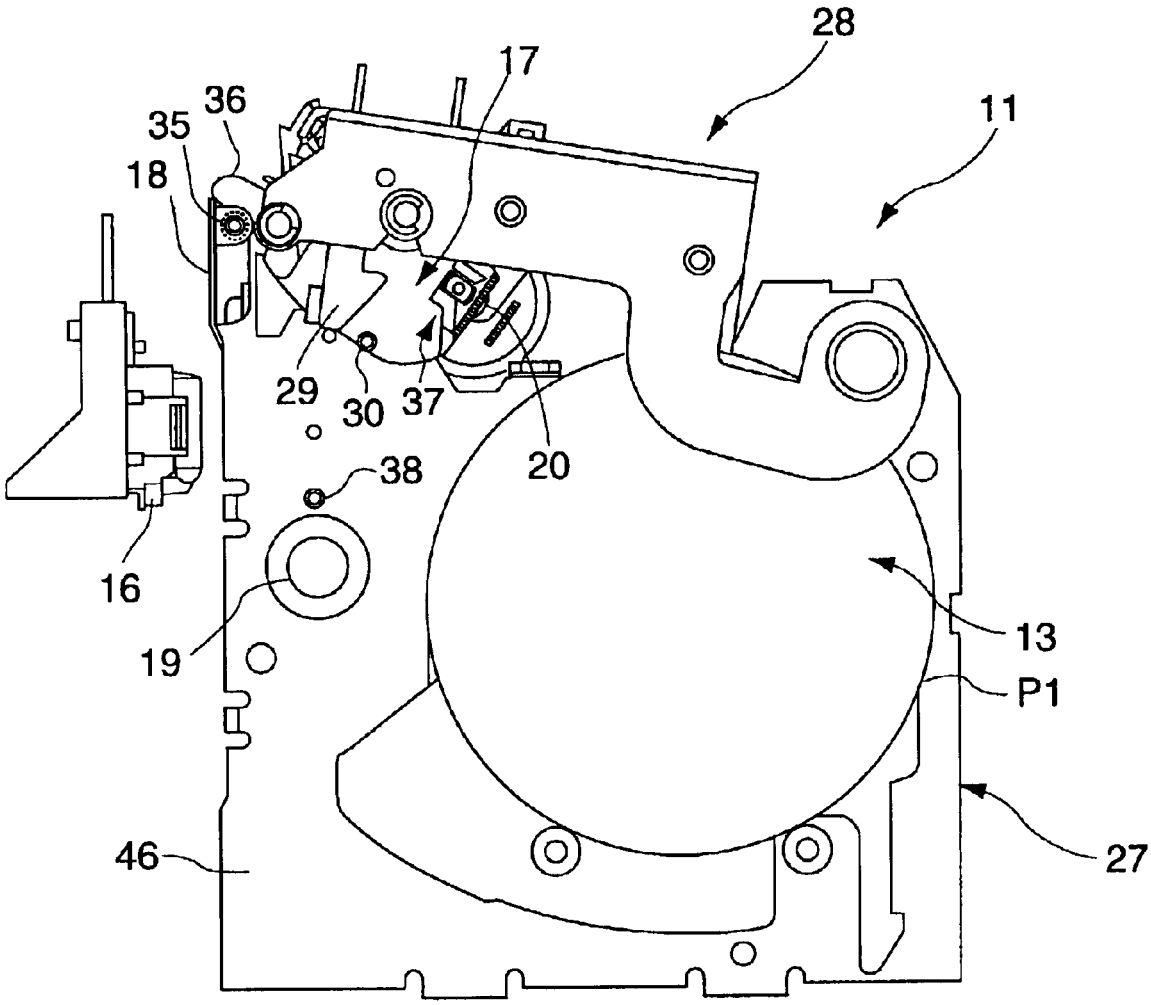
FIG. 8 is a side view of the printer unit when the engagement levers contact the abutment.
Figure 9:
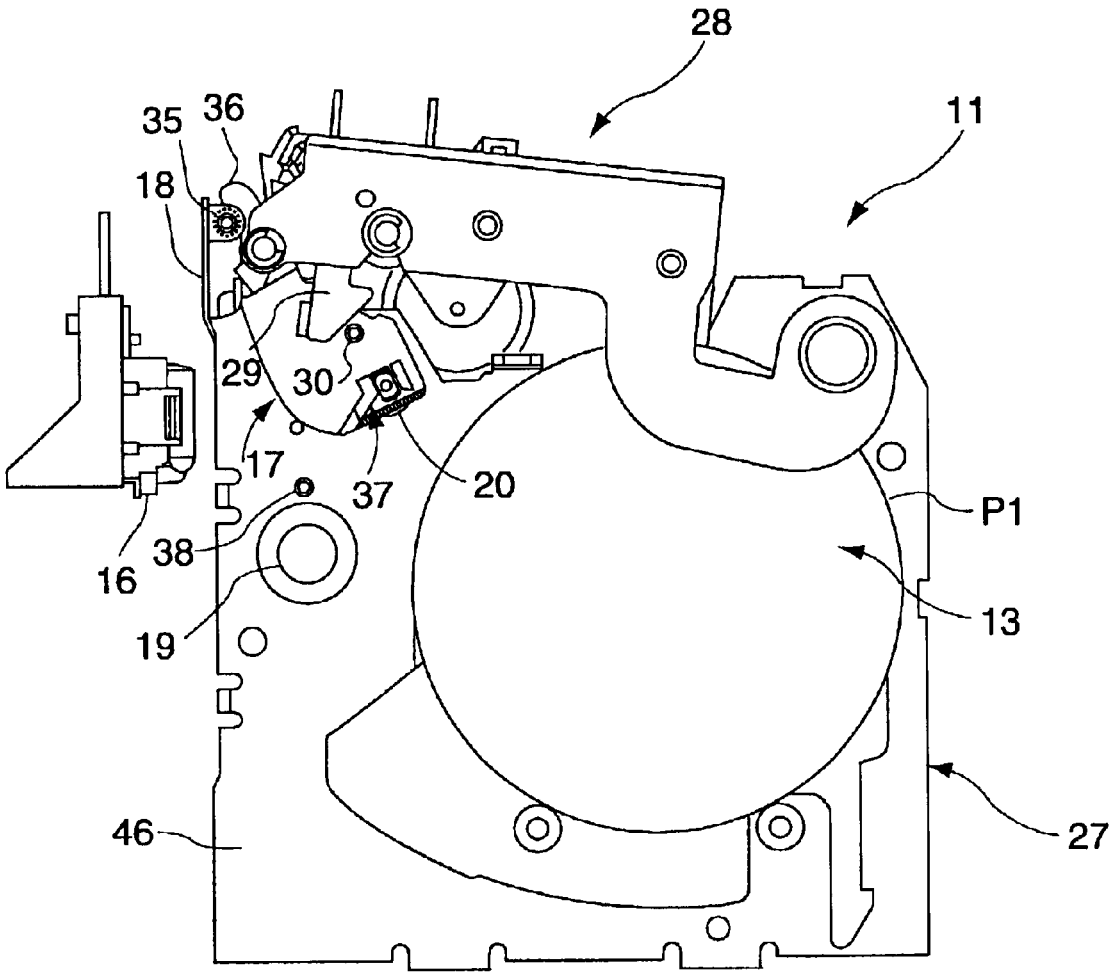
FIG. 9 is a side view of the printer unit when the movable platen starts to rotate away from the cover.
Figure 10:
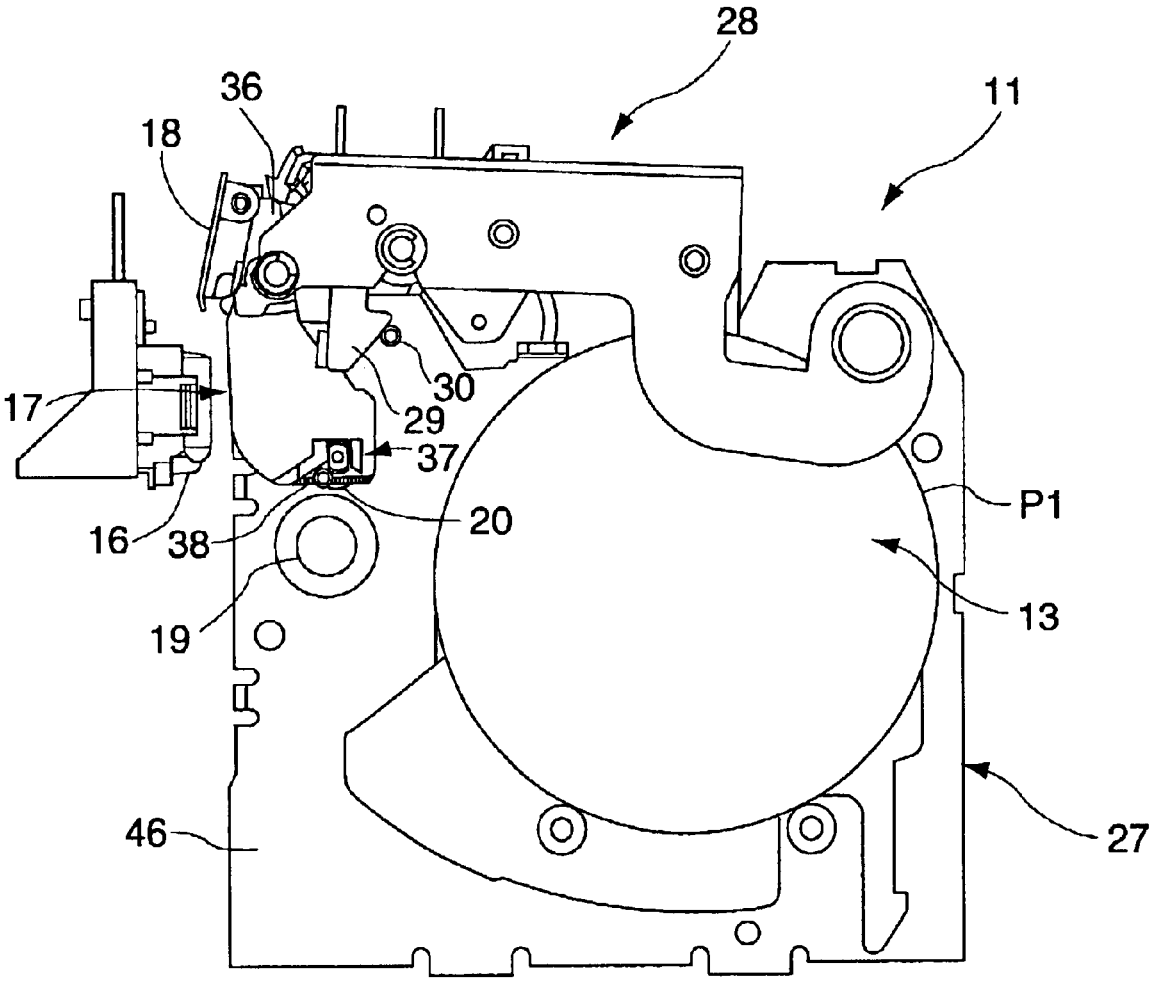
FIG. 10 is a side view of the printer unit just before the cover reaches the fully closed position.

FIG. 7 is a side view of the printer unit when the cover is about half open, FIG. 8 is a side view of the printer unit when the engagement levers contact the abutment, FIG. 9 is a side view of the printer unit when the movable platen starts to rotate away from the cover 28, and FIG. 10 is a side view of the printer unit just before the cover reaches the fully closed position. As will be known from these figures, when the cover 28 is closed after loading paper roll P1 into the paper storage unit 13, the engagement levers 36 of the movable platen 17 engage abutment 35. When the cover 28 is then pressed to the closed position, the engagement levers 36, which are restricted by the abutment 35 from moving further down, rotate clockwise relative to the cover 28 (as viewed in FIG. 8), causing the movable platen 17 to rotate downward and forward away from the cover bottom and against the urging force of the elastic retraction mechanism 60. The movable platen 17 thus rotates downward and forward together with cover 28, and enters the space below the diversion unit 18.

Figure 11:
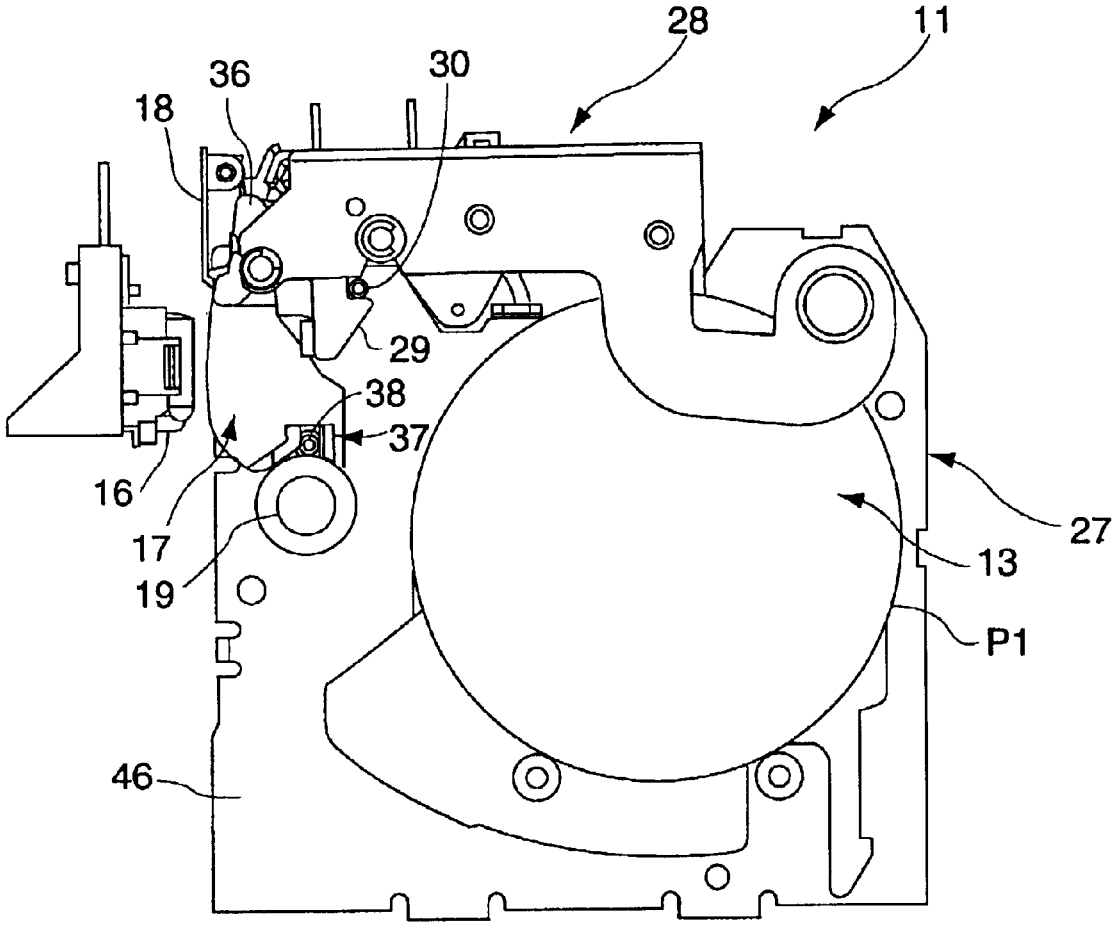
FIG. 11 is a side view of the printer unit when the cover is in the fully closed position.

FIG. 11 is a side view of the printer unit when the cover is in the fully closed position. As shown in FIG. 11 when the cover 28 is closed to the position at which the cover 28 is automatically locked fully closed by the lock levers 29, the movable platen 17 has reached its operative position opposite the print head 16, first movable transportation roller 20 and second movable transportation roller 22 press the roll paper to the first fixed transportation roller 19 and second fixed transportation roller 21, respectively, and the printer 10 is ready to print.

When the cover 28 is thus fully closed and the cover release button 31 is operated, the cover 28 can be opened. When the cover 28 opens, action opposite that of the closing operation and the urging force of the elastic retraction mechanism 60 cause the engagement levers 36 to rotate relatively forward (i.e., counterclockwise as viewed in FIGS. 7 to 11), thus causing the movable platen 17 to rotate toward its inoperative position at the bottom of the cover 28. The movable platen 17 thus rotates up and back in conjunction with the opening motion of the cover 28, and retracts from the space below the diversion unit 18.

Note that when the cover 28 is being closed as described above, first the second movable transportation roller 22 contacts the second fixed transportation roller 21 downstream from print head 16, and subsequently the first movable transportation roller 20 contacts the first fixed transportation roller 19 upstream from the print head 16. This applies appropriate tension to the roll paper pulled out from the paper storage unit 13 through the paper roll transportation path. In addition, because of the offset in the timing at which the first and second movable transportation rollers 20, 22 apply pressure to the roll paper, it is possible to avoid such problems as applying excessive force to the roll paper or the first and second movable transportation rollers 20, 22 applying pressure to the roll paper with slack in the paper.

4. Platen Positioning Mechanism

The movable platen 17 has positioning guide parts 37 on the free end side on both right and left side parts. The positioning guide parts 37 each have a guide channel 37*a* (see FIG. 6) with an opening to the bottom side, i.e., the side opposite to the platen support shaft 32. The positioning guide parts 37 engage a respective guide pin 38 (fixed guide part) fixed on the corresponding unit frame side to precisely position the movable platen 17 in its operative position. More specifically, as shown in FIG. 10, when the cover 28 is closed to the position just before the fully closed position, the abutment 35 substantially stops rotation of the movable platen 17, and the movable platen 17 descends substantially vertically with slight free rotation allowed. An inclined guide surface 37*b* (see FIG. 6) formed on the bottom part of positioning guide part 37 contacts fixed guide pin 38 at this time, guiding the fixed guide pin 38 into the guide channel 37*a* and thus guiding the movable platen 17 into position. This assures that the movable platen 17, in its operative position is positioned accurately relative to the print head 16. More specifically, a specified gap is formed between the platen surface and the nozzle surface of the print head whereby the movable platen 17 supports the paper relative to the print head 16. Note that forming such gap is not essential to the present invention. If a thermal head is used as print head 16, for instance, the guide channel 37*a* would have to be formed in a way so that the platen elastically presses the (thermal) paper against the print head.

The guiding direction (engaging direction) of the guide channel 37*a* is substantially perpendicular to the direction in which the movable platen 17 separates from the print head 16, and is substantially perpendicular to a line tangent to the first movable transportation roller 20 and first fixed transportation roller 19.

The positioning guide parts 37 thus reliably limit the escape of movable platen 17 from the print head 16, and also accurately position the first movable transportation roller 20 to the first fixed transportation roller 19.

5. Configuration of the Diversion Unit

Figure 12:
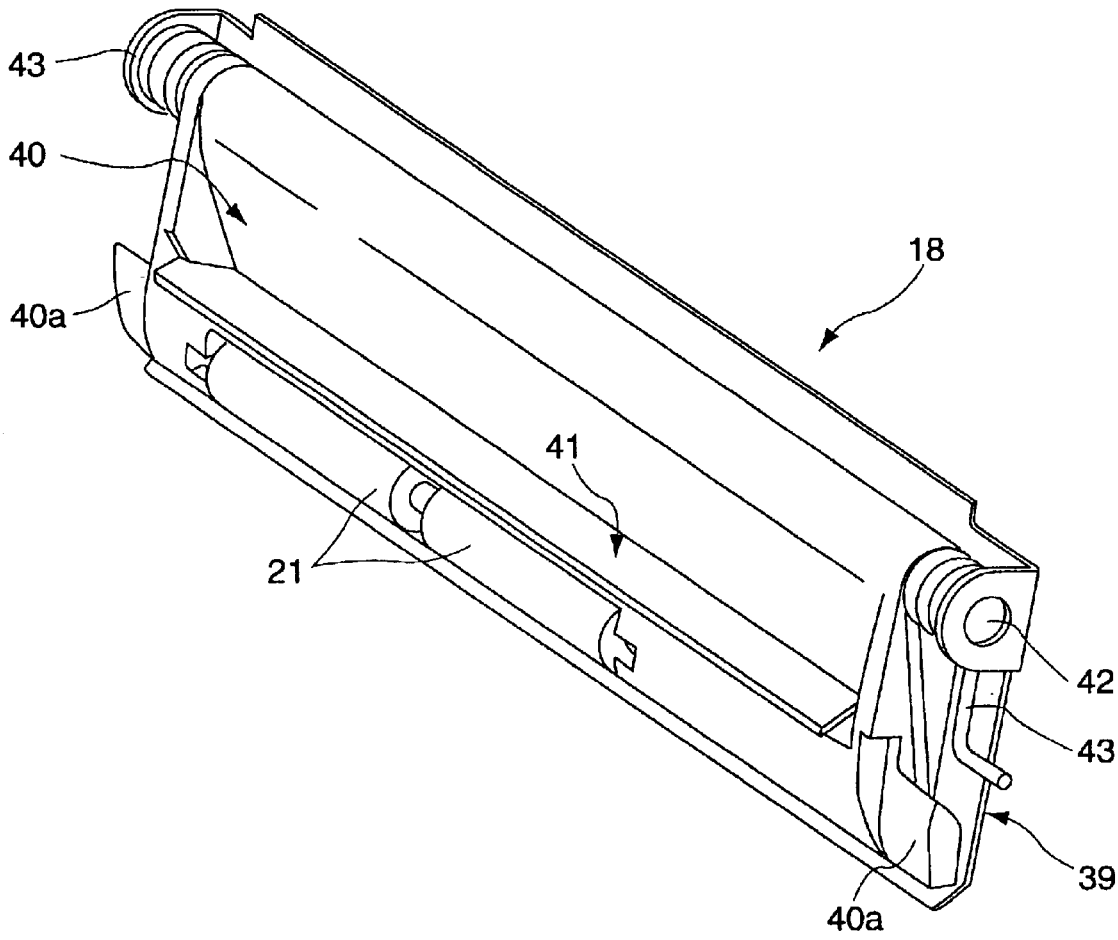
FIG. 12 is a perspective view of the diversion unit.

FIG. 12 is a perspective view of the diversion unit. As shown in FIG. 12, the diversion unit 18 has a diverter plate 39 forming a single-sheet paper transportation path, a support member 40, and a fixed knife 41. The support member 40 is disposed on the back of the diverter plate 39 and freely rotatably axially supports the second fixed transportation roller 21. The fixed knife 41 is disposed at support member 40 and is used to cut the ejected part of the roll paper. The diversion unit 18 thus comprised is disposed to rotate freely back and forth on the unit frame 27 by way of diverter support shaft 42, and is urged to the movable platen 17 side (second movable transportation roller 22 side) by a presser spring 43 disposed at both right and left ends of the diverter support shaft 42. More specifically, the diversion unit 18 is constructed so that it can retract to a position not interfering with cover 28 opening and closing operations, and to press the second fixed transportation roller 21 to the second movable transportation roller 22 with the urging force of presser springs 43 when the cover 28 is in the closed position to assure reliable paper transportation. It should be noted that one end of the presser springs 43 is engaged in a channel on the respective side of unit frame 27, and the other end is engaged by protrusion 40*a* of support member 40.

6. Paper Cutter Mechanism

Figure 24:
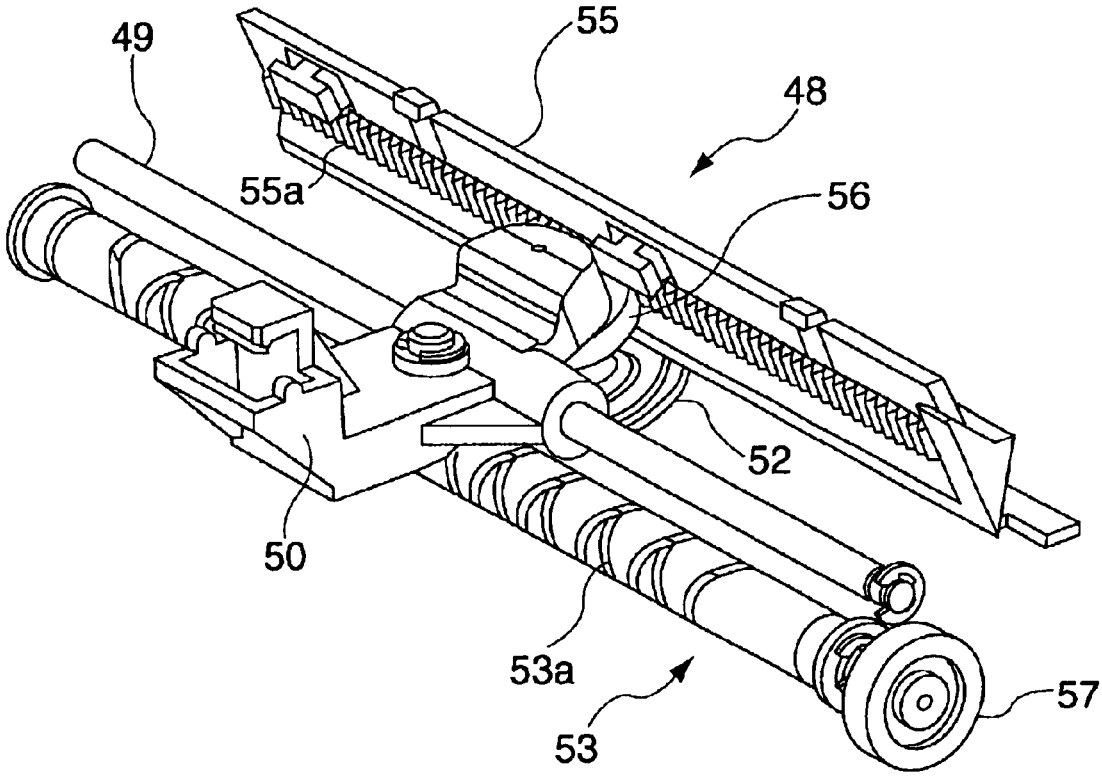
FIG. 24 is a perspective view of the paper cutter mechanism.
Figure 25:
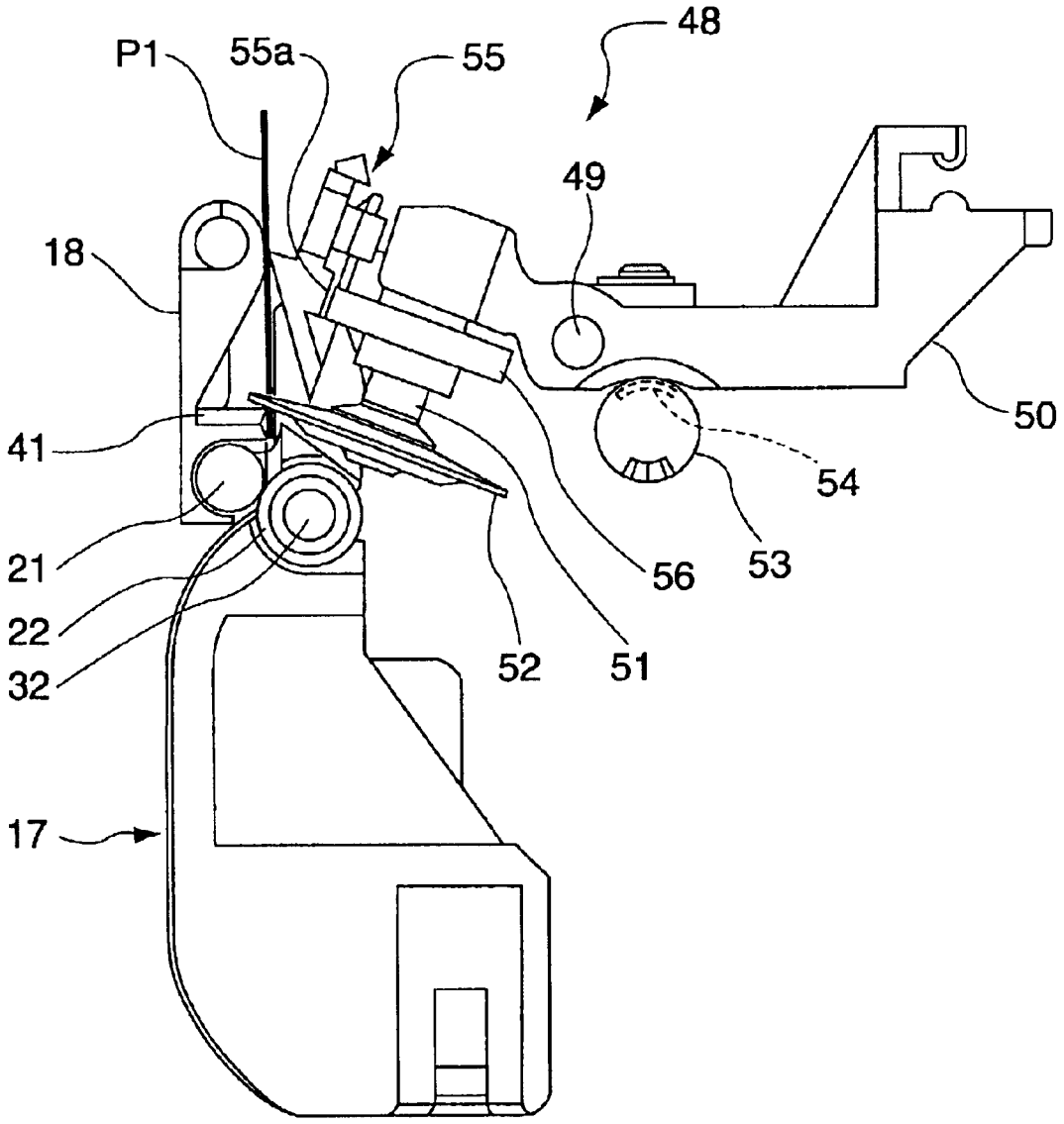
FIG. 25 is a side view of the paper cutter mechanism.

FIG. 24 is a perspective view and FIG. 25 is a side view of the paper cutter mechanism. As shown in these figures the paper cutter mechanism 48 has the fixed knife 41 disposed side to side on the diversion unit 18, a guide shaft 49 disposed side to side at the end side of the cover 28, a movable knife support member 50 freely movable side to side along the guide shaft 49, a rotating shaft 51 projecting downward from the front edge part of the movable knife support member 50, a rotary-type movable knife 52 disposed integrally to the bottom end part of the rotating shaft 51, and a cam shaft 53 for reciprocally moving the movable knife support member 50 side to side.

The cam shaft 53 is supported at the free end side of the cover 28 to rotate freely and has a cam groove 53*a* formed in the outside surface thereof for producing a side to side movement. The cam groove 53*a* is an endless groove having two spiral grooves winding in opposite directions and connecting channel parts linking the ends of the spiral grooves. The cam groove 53*a* engages a follower member 54 freely rotatably coupled to the movable knife support member 50. This configuration causes the movable knife support member 50 and movable knife 52 to move reciprocally along the fixed knife 41 while the cam shaft 53 rotates in one direction. Drive power from the transportation motor is transferred to the cam shaft 53 via a cam shaft gear 57 disposed at the left end part of the cam shaft 53.

As shown in FIG. 25, a paper guide 55 is disposed from side to side between the rotating shaft 51 and the roll paper transportation path. This paper guide 55 functions as an exit guide for the roll paper and has a fixed rack 55*a* formed integrally to the back thereof from side to side.

A gear 56 for rotating the movable knife is disposed integrally to the rotating shaft 51, and meshes with fixed rack 55*a* so that as the movable knife support member 50 moves the movable knife 52 is turned in an appropriate direction (the direction in which the edge of the movable knife 52 rotates toward the fixed knife 41).

It is therefore possible to rotate the movable knife 52 in the appropriate direction without disposing an intermediate gear between the fixed rack 55*a* and knife gear 56. When seen from the side, the rotating shaft 51 is positioned at an angle to the roll paper transportation path so that the down side (the movable knife 52 side) approaches the roll paper transportation path and the top side (the knife gear side) recedes from the roll paper transportation path. It is therefore possible to assure space for the fixed rack 55*a* (paper guide 55) between the roll paper transportation path and knife gear 56 while reducing the size of the movable knife 52.

7. Cover Locking Mechanism

Figure 13:
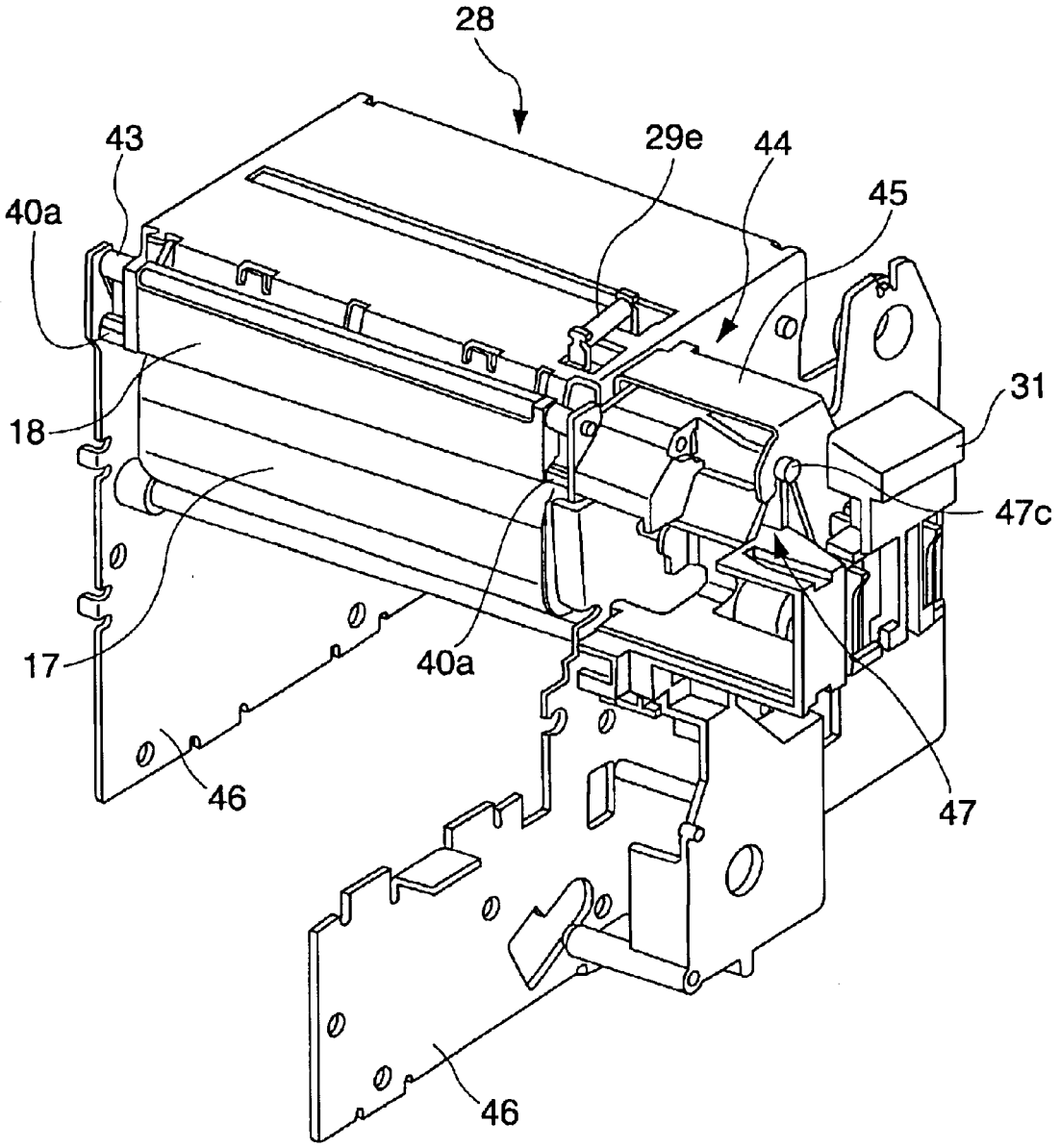
FIG. 13 is a perspective view of the entire printer unit showing the cover locking mechanism.
Figure 14:
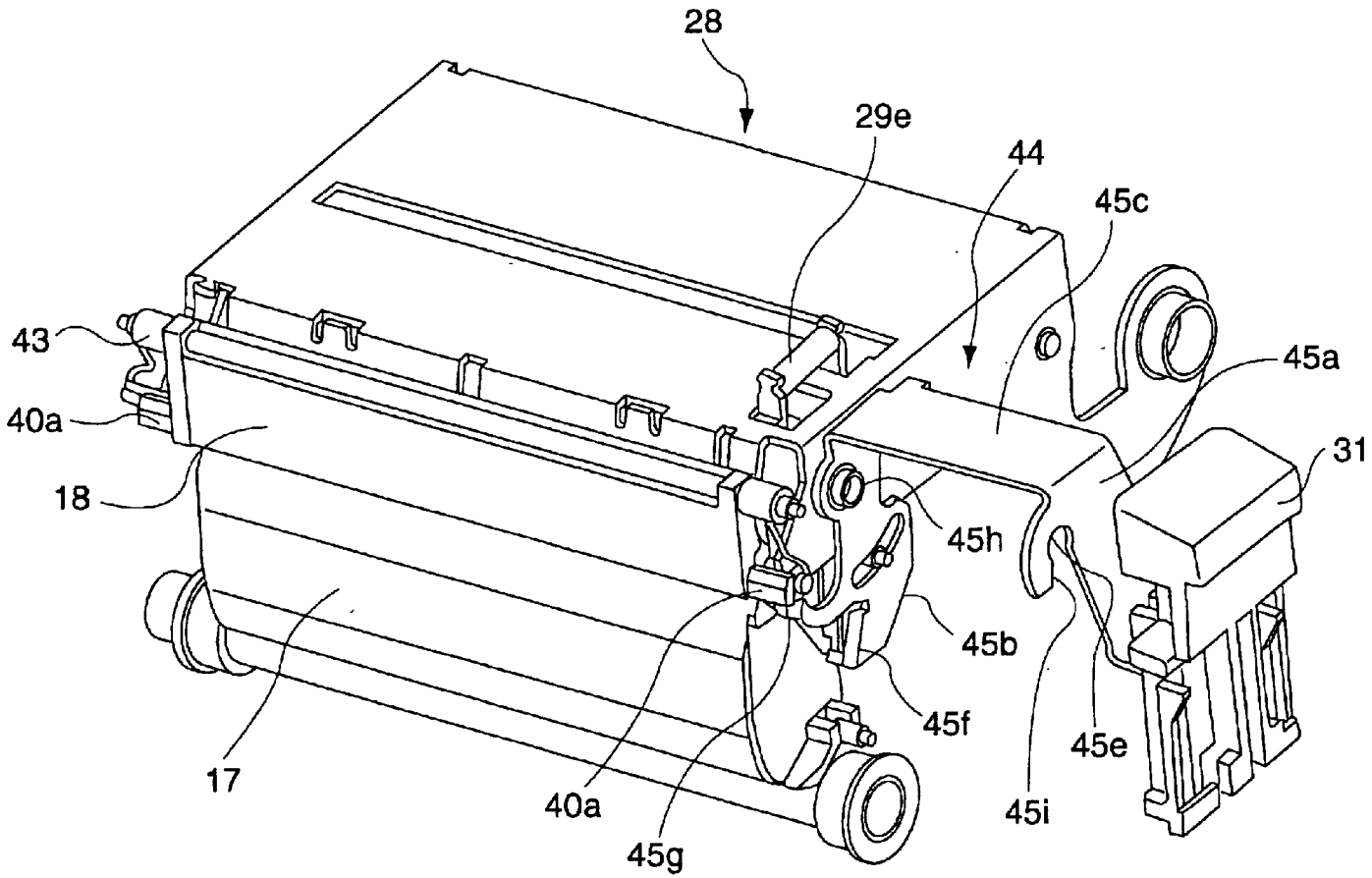
FIG. 14 is a perspective view of the cover locking mechanism from above.
Figure 15:
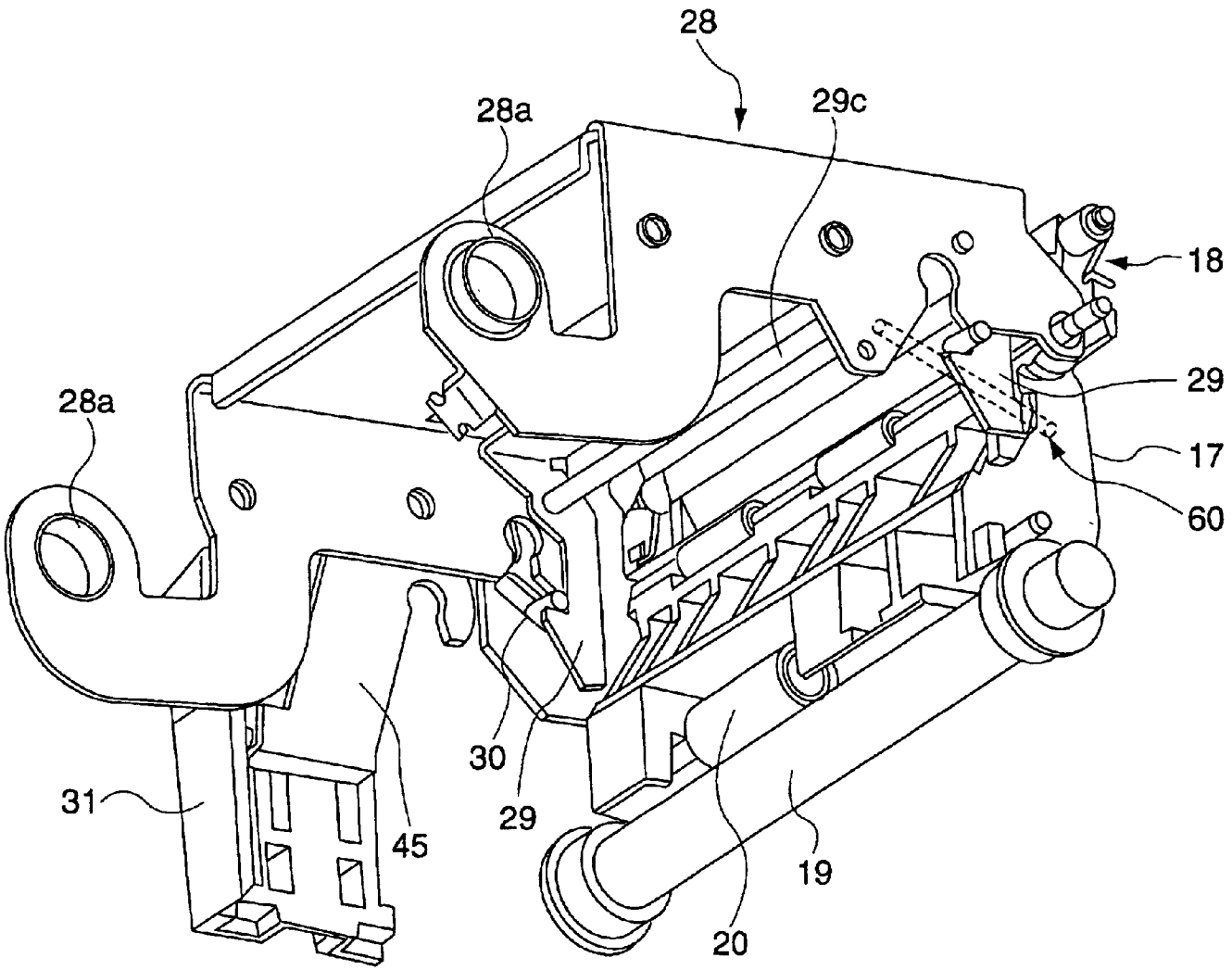
FIG. 15 is a perspective view of the cover locking mechanism from below.

FIG. 13 is a perspective view of the entire printer unit showing the cover locking mechanism, FIG. 14 is a perspective view of the cover locking mechanism as seen from above, and FIG. 15 is a perspective view of the cover locking mechanism as seen from below. As shown in these figures, the cover locking mechanism 44 includes the above-described lock levers 29 disposed on the cover side, the lock pins 30 disposed on the unit frame side, and a lock release lever 45 for moving the lock levers 29 to the lock release side (unlocked position) according to the operation of the cover release button 31.

The lock levers 29 each have a hook part 29*a* (see also FIG. 16) for engaging the lock pin 30, and an inclined guide part 29*b* (see also FIG. 16) for automatically engaging the lock pin 30. The lock levers 29 are disposed on right and left sides at the free end side of the cover 28. The base end parts of the pair of lock levers 29 are integrally linked by an intervening pipe-like connecting rod 29*c*, are supported so as to pivot freely back and forth on a lever support shaft 29*d* fit to connecting rod 29*c*, and are urged by a restoring spring 29*e* in the lock pin engaging direction. The lock pins 30 project to the inside part of the side frame 46, and engage the lock levers 29 to hold the cover 28 in the closed position.

The lock release lever 45 has a first lever part 45*a* linked to the cover release button 31, a second lever part 45*b* linked to the lock levers 29 and diversion unit 18, and a connecting part 45*c* integrally connecting the top end parts of both lever parts 45*a* and 45*b*. The first lever part 45*a* has a button engaging part 45*d* for engaging the cover release button 31 (see FIG. 16), and a pivot hole 45*e* that is fit to rotation support part 47*a* of the lock release lever support member 47 further described below. The first lever part 45*a* is thus supported so that it pivots freely back and forth on pivot hole 45*e*. The second lever part 45*b* has a lock lever engaging part 45*f* for engaging the engaging tab 29*f* of the right side lock lever 29, a diverter engaging part 45*g* for engaging protrusion 40*a* of diversion unit 18, and a burring part 45*h* that is fit into a pivot hole (not shown in the figure) in the side frame 46. The second lever part 45*b* is thus supported to pivot freely back and forth on the burring part 45*h*.

The cover release button 31 is affixed to the unit frame 27 so that the button can slide freely in a linear direction, and in this preferred embodiment of the invention is operated to be pushed straight down.

Figure 16:
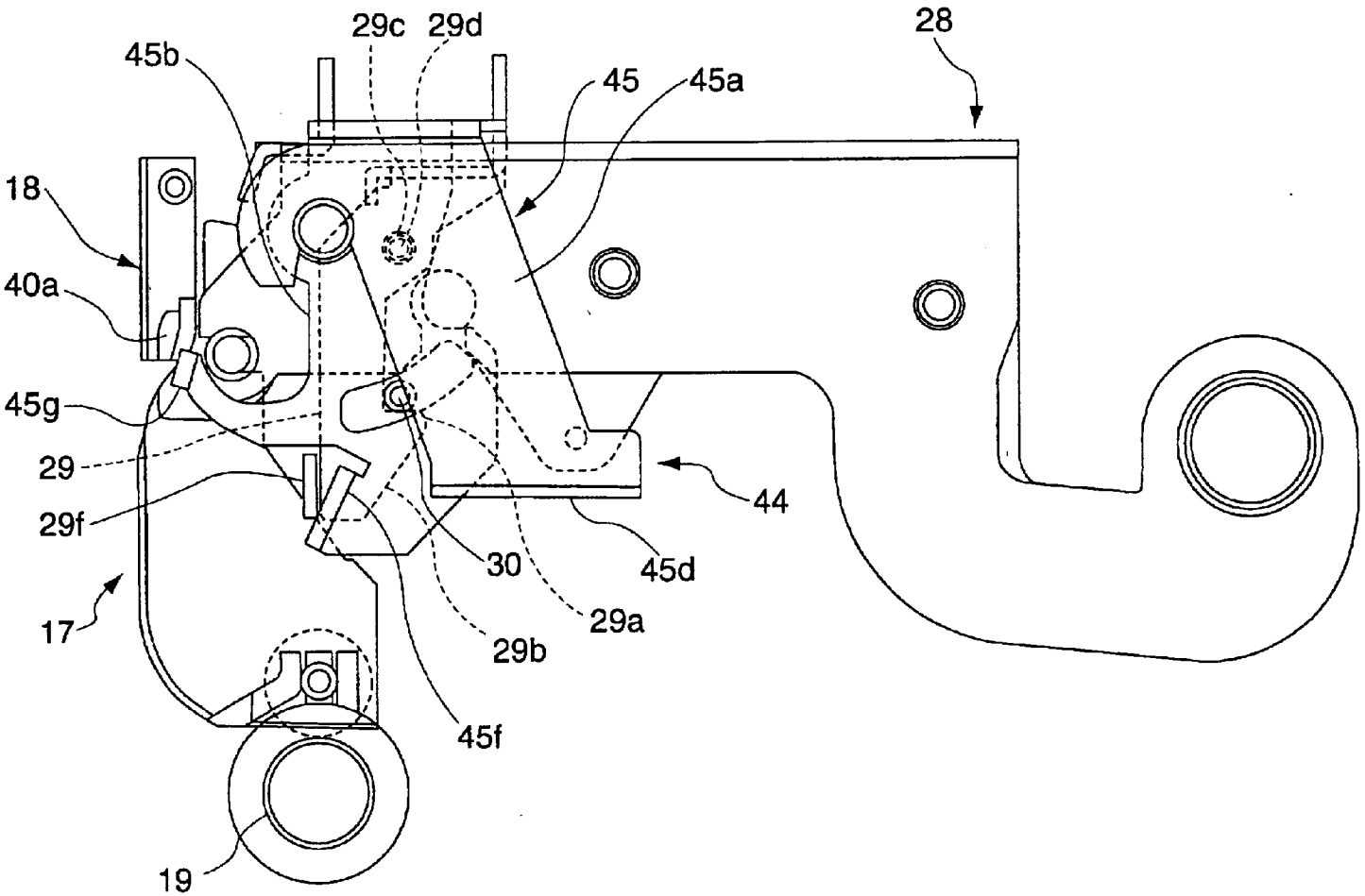
FIG. 16 is a side view of the cover locking mechanism when the cover is in the fully closed position.

FIG. 16 is a side view of the cover locking mechanism when the cover is in the fully closed position. When the cover 28 is completely closed as shown in FIG. 16, lock levers 29 engage lock pins 30 and hold the cover 28 closed. The urging force of presser spring 43 also causes the diversion unit 18 to press second fixed transportation roller 21 to second movable transportation roller 22.

8. Unlocking the Cover and Retracting the Diversion Unit

Figure 17:
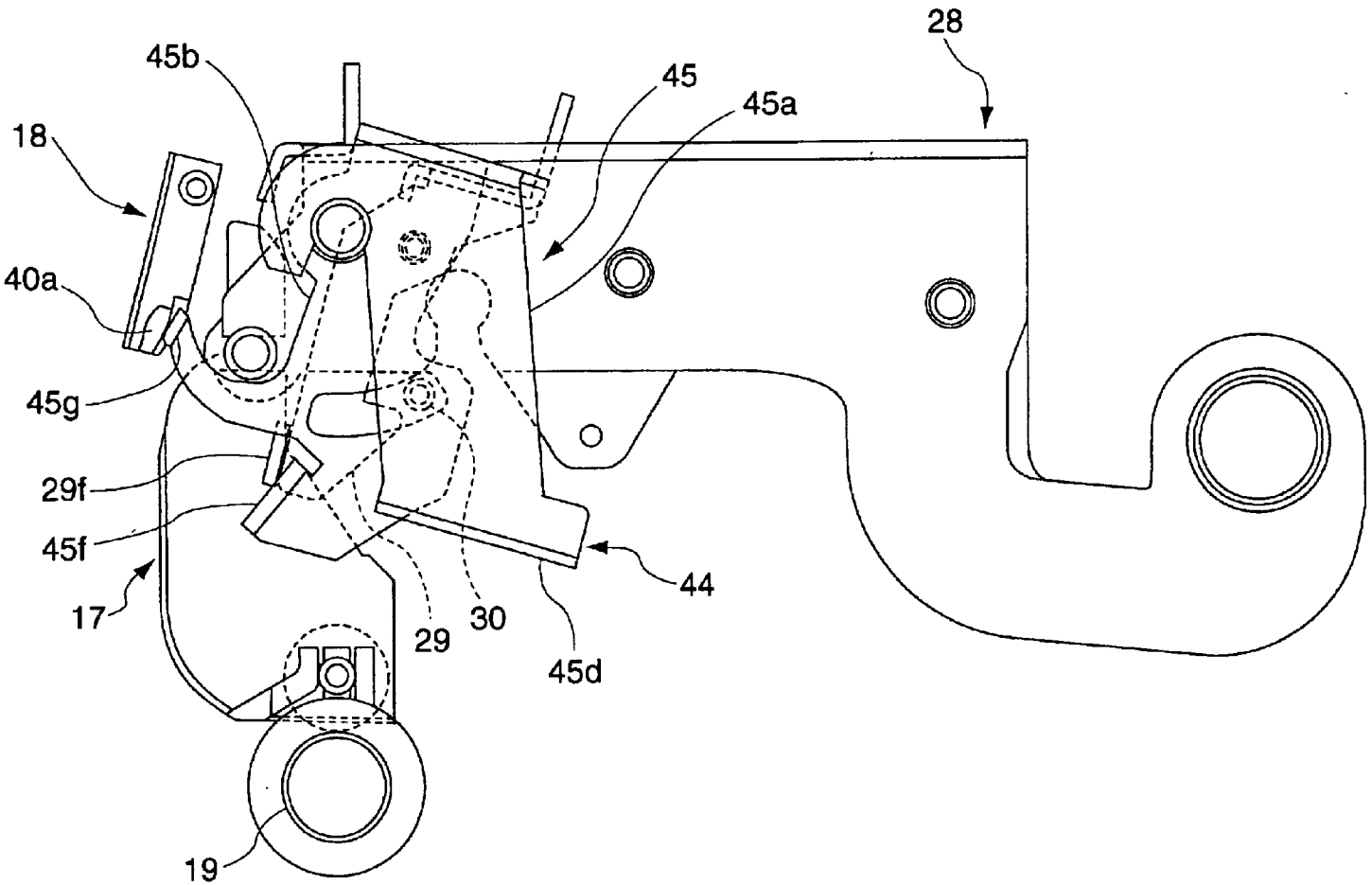
FIG. 17 is a side view of the cover locking mechanism just after the cover release button is operated.
Figure 18:
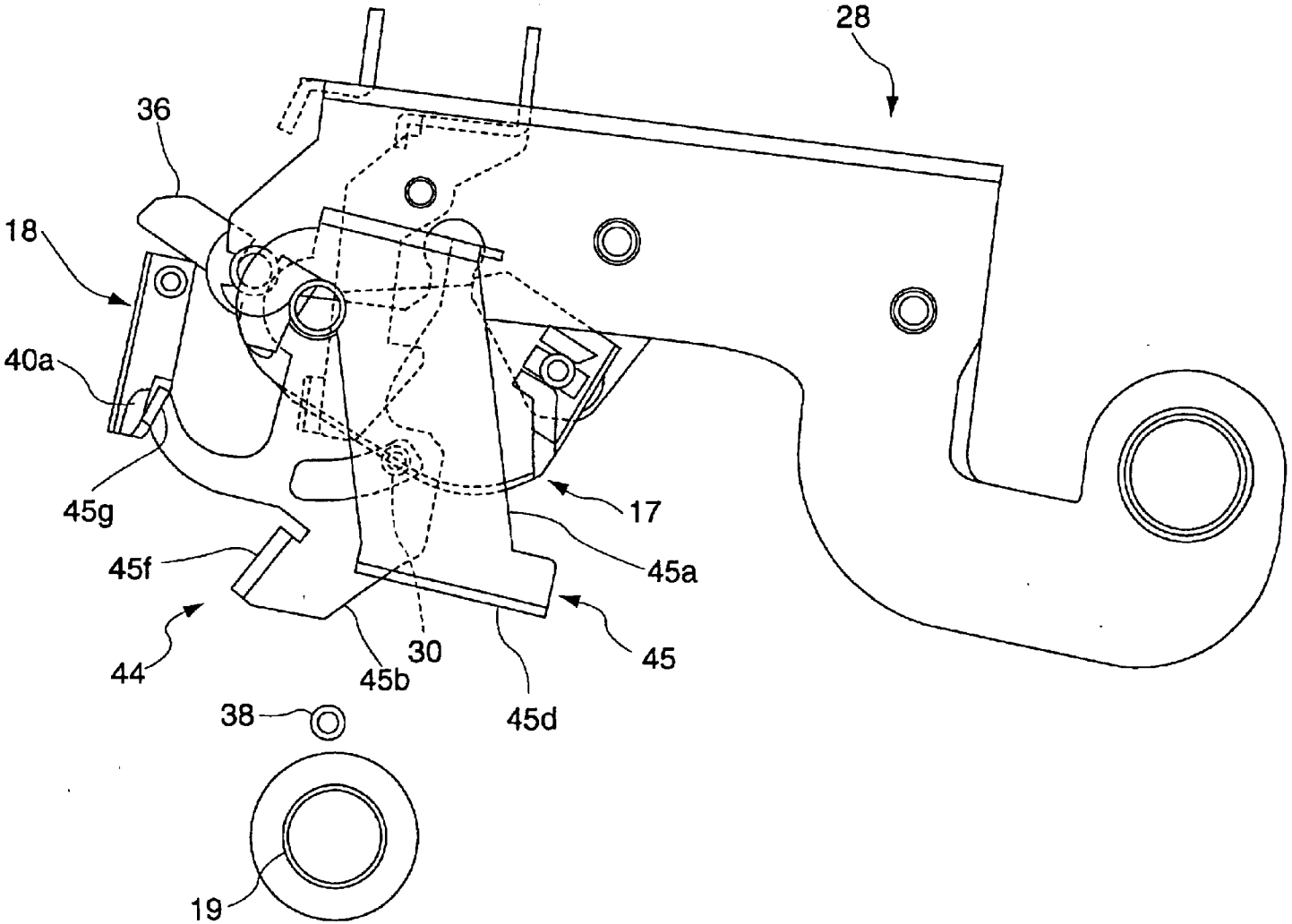
FIG. 18 is a side view of the cover locking mechanism at the start of the cover opening operation.

FIG. 17 is a side view of the cover locking mechanism just after the cover release button 31 is operated, and FIG. 18 is a side view of the cover locking mechanism at the start of the cover opening operation. As indicated in these figures, when the cover release button 31 is pushed in a straight line while the cover 28 is in the fully closed position, the operating force of the button rotates the lock release lever 45 forward. When the lock release lever 45 rotates forward the lock lever engaging part 45*f* of second lever part 45*b* pushes the engaging tab 29*f* of lock levers 29 forward, causing the lock levers 29 to move to the lock releasing side and thereby allowing the cover 28 to open. Simultaneously thereto the diverter engaging part 45*g* of second lever part 45*b* pushes protrusion 40*a* of diversion unit 18 forward. The diversion unit 18 therefore retracts automatically to a position not interfering with opening and closing cover 28, and the cover 28 can open smoothly.

Figure 19:
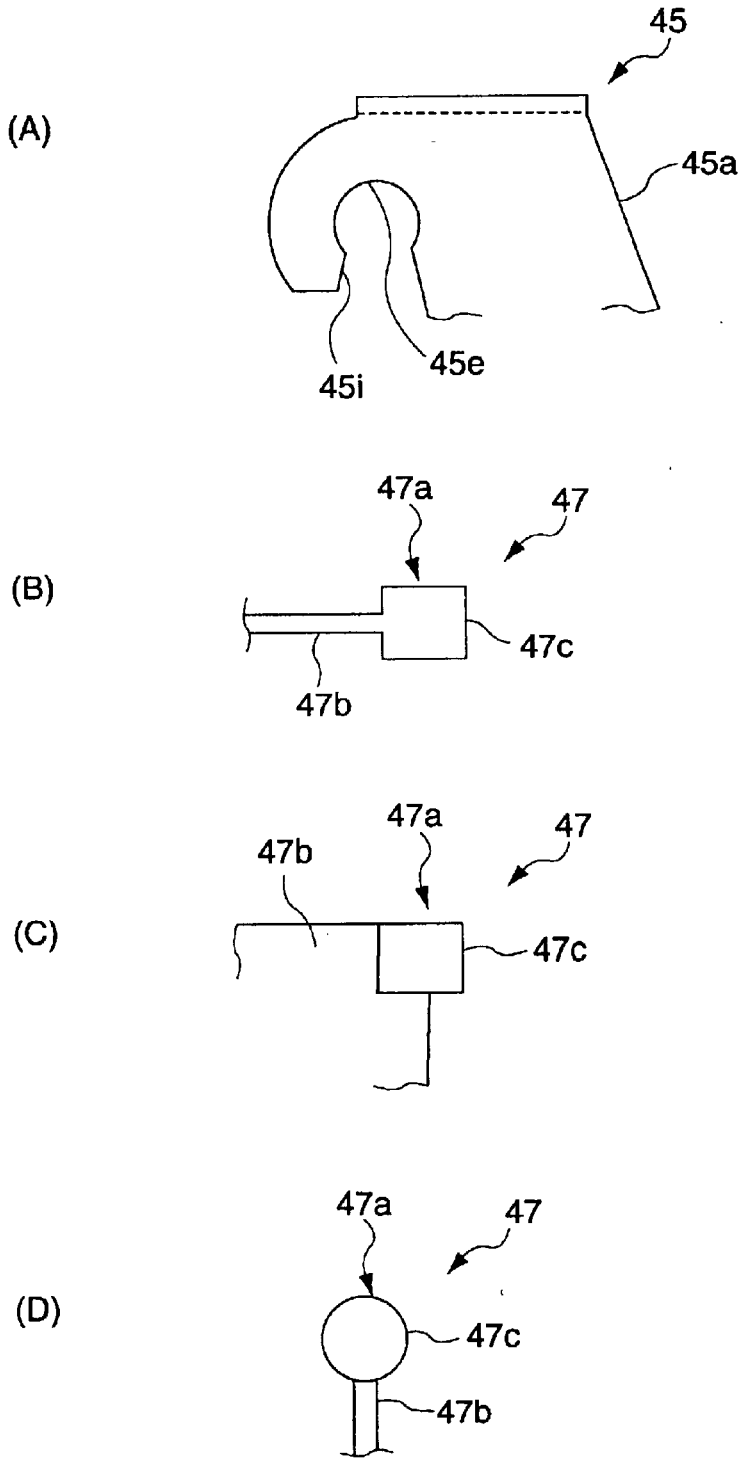
FIG. 19(A) is a side view showing the pivot part of the lock release lever.
FIGS. 19(B), 19(C), and 19(D) are a plan view, a front view, and a side view, respectively, of the pivot part of the lock release lever support member.

FIG. 19(A) is a side view showing the pivot part of the lock release lever 45, and FIGS. 19(B), 19(C), and 19(D) are a plan view, front view, and side view, respectively, of the pivot part of the lock release lever support member 47. As shown in these figures a notched part 45*i* open to the bottom and contiguous to the pivot hole 45*e* is formed in the first lever part 45*a* of lock release lever 45. The lock release lever support member 47 is a resin molding having rotation support part 47*a* integrally disposed to the right top part thereof. The rotation support part 47*a* has a flat narrow part 47*b* to which the notched part 45*i* of lock release lever 45 is fit from above, and a pivot shaft part 47*c* projecting to the right side from narrow part 47*b*. When the notched part 45*i* is fit to the narrow part 47*b*, pivot hole 45*e* can be fit to the pivot shaft part 47*c* so that the first lever part 45*a* of lock release lever 45 is pivotally supported by the pivot shaft part 47*c*.

9. Structure for Installing the Lock Release Lever

Figure 20:
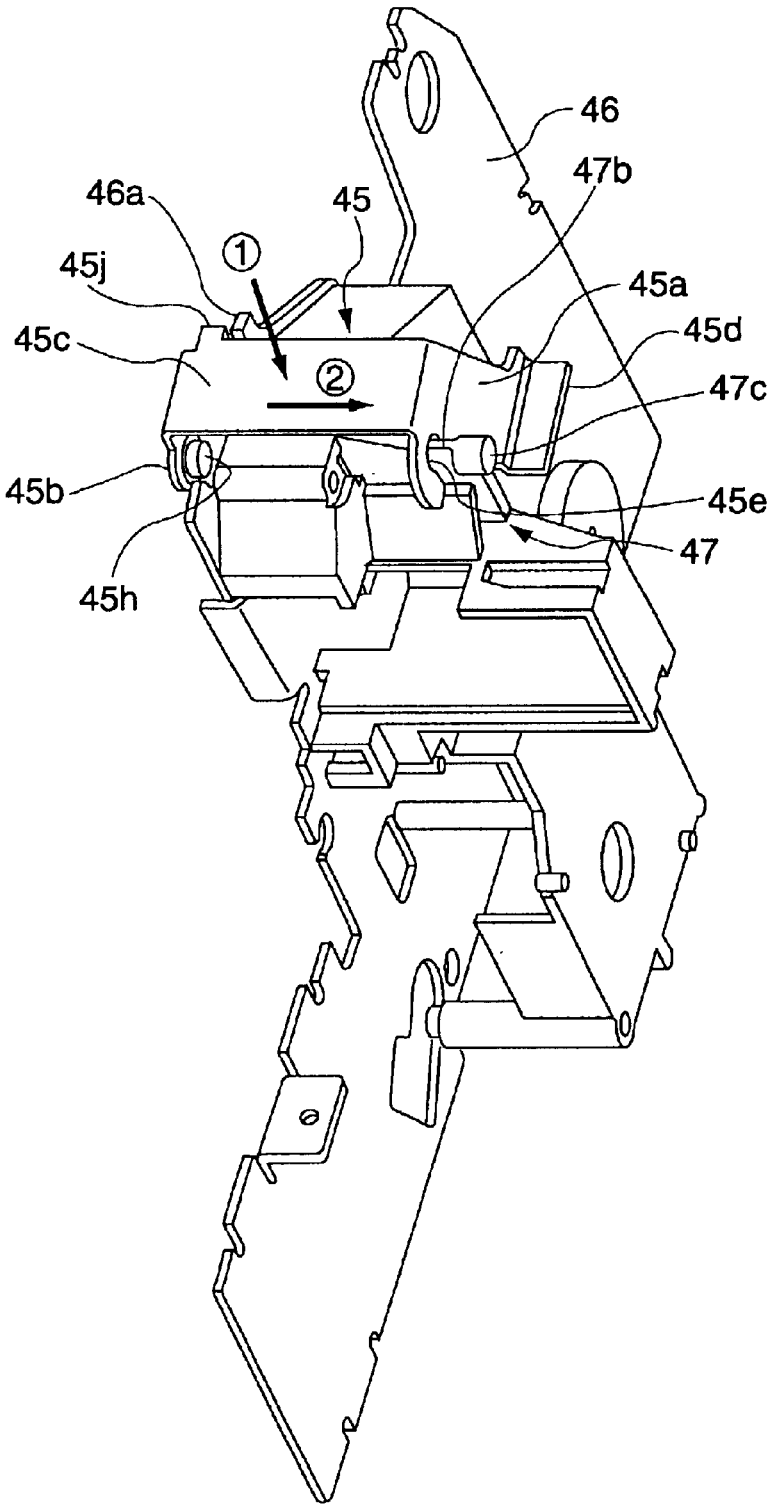
FIG. 20 to FIG. 23 show the installation of the lock release lever.
Figure 21:
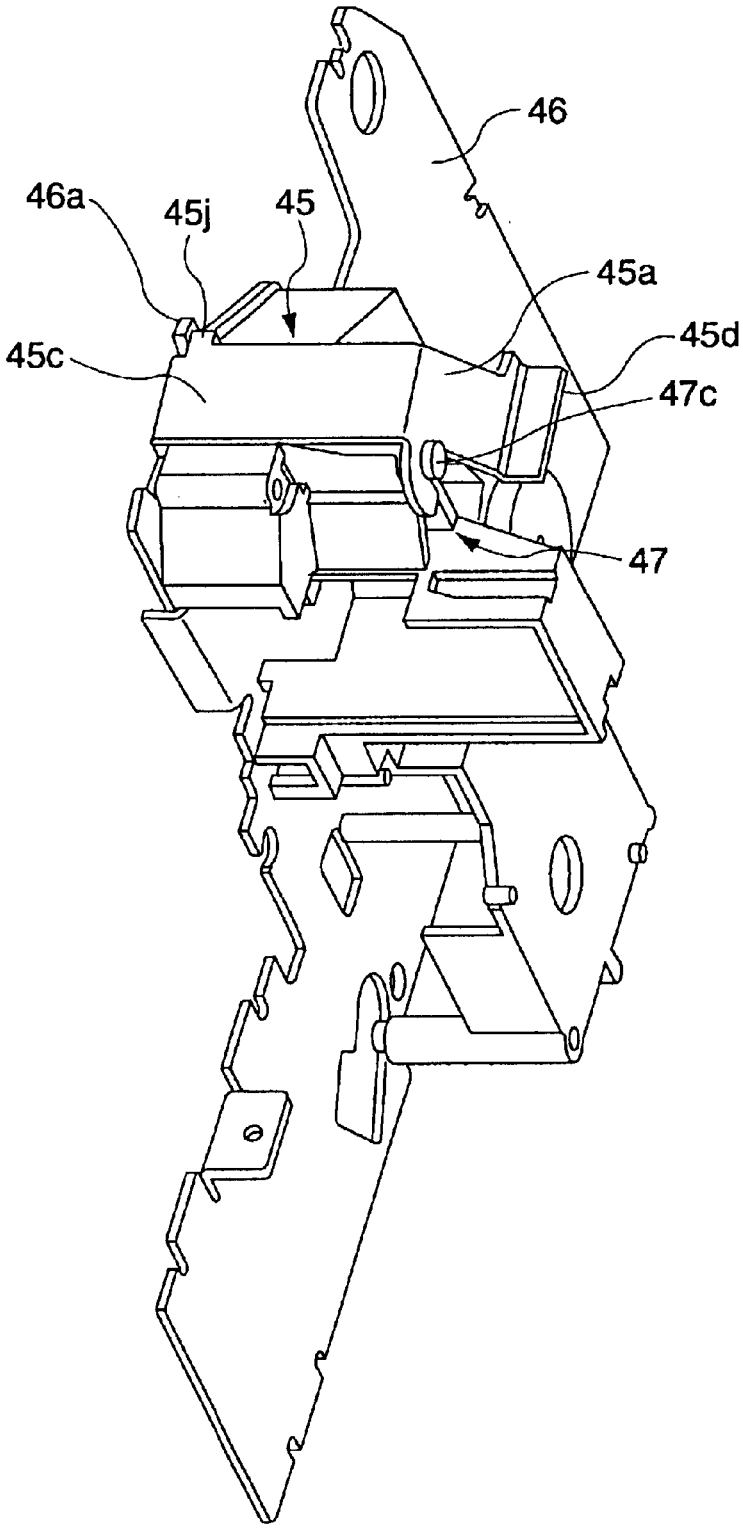
Figure 22:
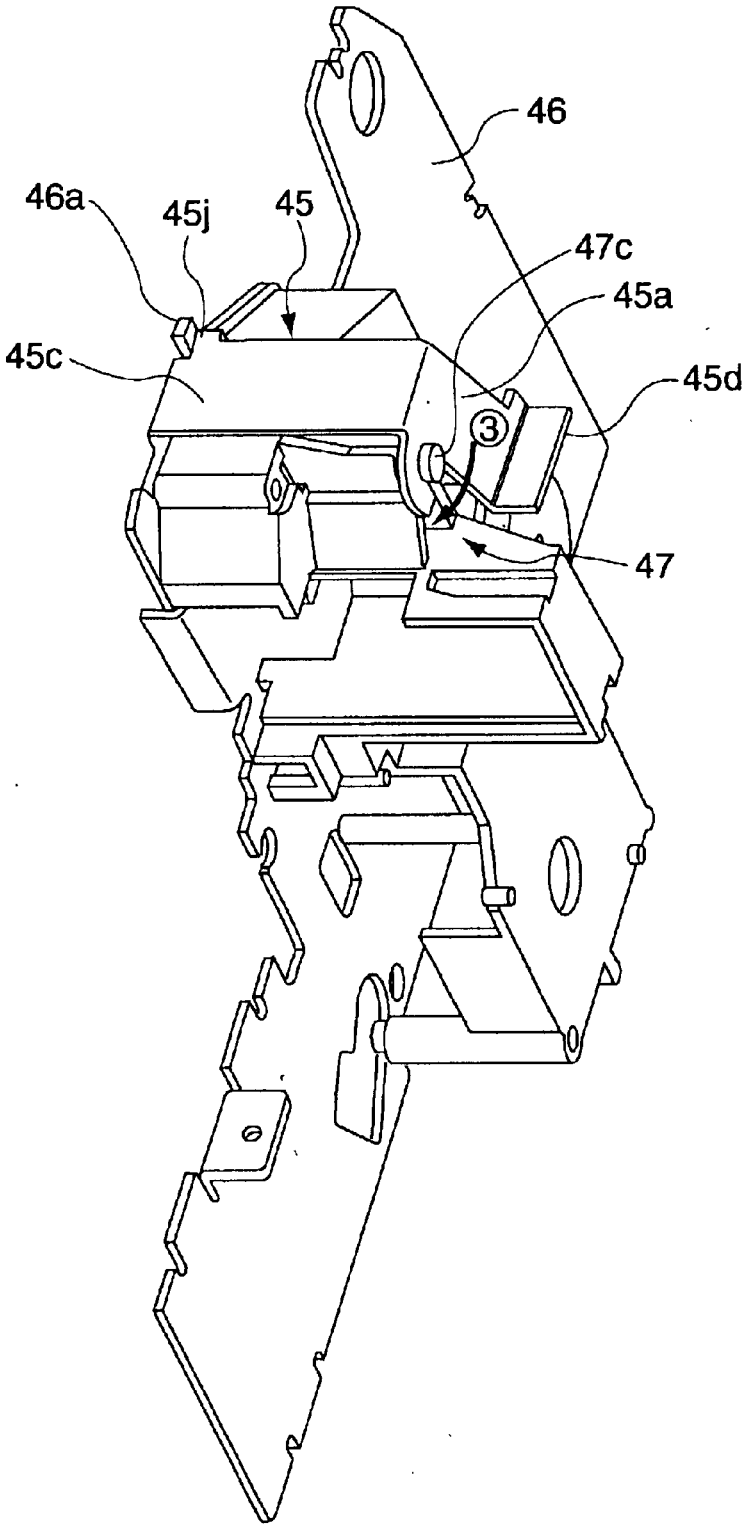
Figure 23:
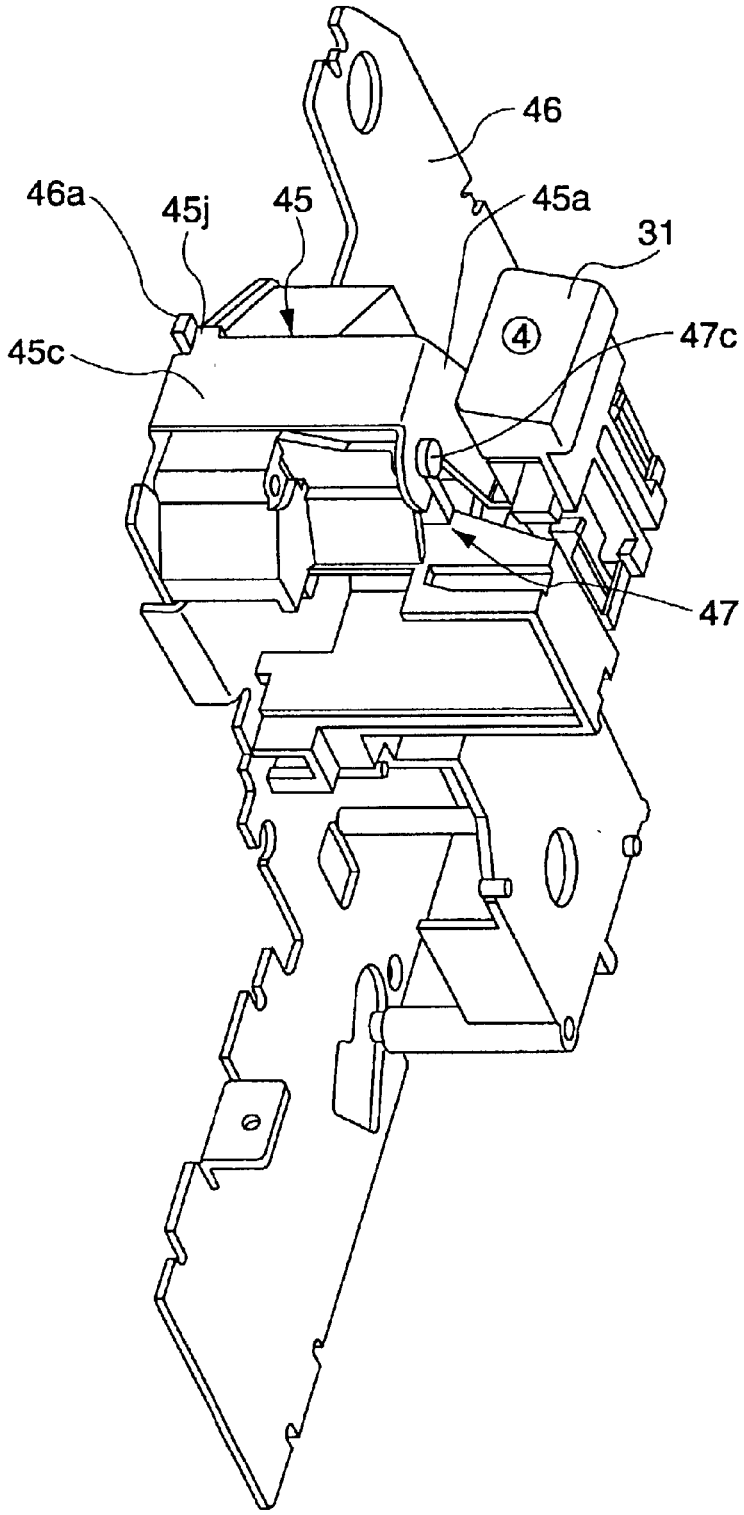

The structure for installing the lock release lever is described next below with reference to FIGS. 20 to 23. As shown in FIG. 20, the lock release lever 45 is first tilted forward (outside the normal range of rotation) and the notched part 45*i* of first lever part 45*a* is fit down onto the narrow part 47*b* of lock release lever support member 47 (see arrow (1) in FIG. 20). The lock release lever 45 is then slid to the right as seen in the figures to fit the pivot hole 45*e* in first lever part 45*a* to the pivot shaft part 47*c* of lock release lever support member 47, and fit the burring part 45*h* of second lever part 45*b* into the pivot hole in the side frame 46 (see arrow (2) in FIG. 20). Next, the lock release lever 45 is rotated into the normal range of rotation and the engaging abutment 45*j* formed on the left end part of the lock release lever 45 is engaged with the stopper 46*a* formed on side frame 46 (see arrow (3) in FIG. 22). Sideways movement of the lock release lever 45 is thus limited by the second lever part 45*b* contacting the left side of the side frame 46 and the engaging abutment 45*j* engaging the stopper 46*a* from the right side. The cover release button 31 is then installed to the unit frame 27 so that it can slide freely up and down (see (4) in FIG. 23). Rotation of the lock release lever 45 beyond the normal range of rotation is thus limited by the cover release button 31.

10. Alternative Configuration of the Platen Positioning Construction

An alternative configuration of the movable platen 17 positioning construction is described next. It should be noted that elements having the same function in the configuration described above are identified by like reference numerals and further description thereof is omitted below.

Figure 26:
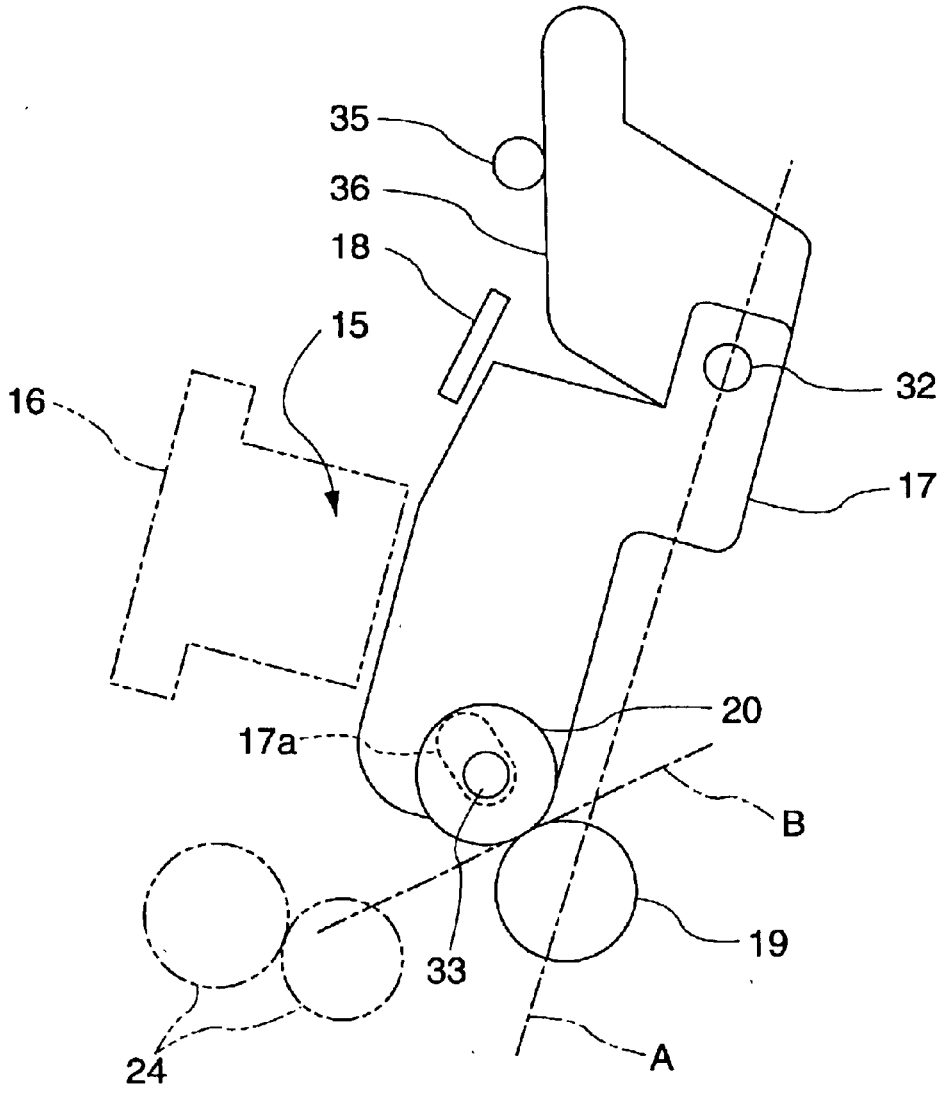
FIG. 26 is a schematic side view showing the location of the first transportation roller pair in an alternative embodiment of the invention.

FIG. 26 is a schematic side view showing the location of the first transportation roller pair. As shown in the figure, this alternative embodiment transports roll paper by means of first transportation roller pair 19, 20 on the upstream side of the print head 16 without providing the second transportation roller pair 21, 22 on the downstream side of the print head 16. As seen in this side view, the roller shaft 33 of first movable transportation roller 20 is disposed on the print head side of an imaginary line A passing through the center of the pivot axis of movable platen 17 (platen support shaft 32) and the center of first fixed transportation roller 19. In other words, roller tangent B tangent to first transportation roller pair 19, 20 slopes toward the print head 16, thus limiting movement of first movable transportation roller 20 away from the print head 16 and applying pressure pushing the first movable transportation roller 20 forward towards the print head 16. The movable platen 17 can thus be positioned using the first transportation roller pair 19, 20, and a specified gap can be formed between the movable platen 17 and print head 16. When the roller shaft 33 is positioned as described above the first movable transportation roller 20 must be able to travel over the first fixed transportation roller 19 when the cover 28 is opened and closed. The roller shaft 33 is therefore supported in elliptical holes 17*a* (accommodating means) so that it can move freely up and down relative to the movable platen 17, and is urged downwardly by an elastic mechanism not shown in the figures.

As will be known from the above, a printer 10 according to a preferred embodiment of the invention has a housing (including cover 12 and unit frame 27) with a paper storage unit 13 for holding paper roll P1, a cover 28 for opening and closing an opening 26 to paper storage unit 13, a print head 16 for printing on roll paper pulled off the paper roll P1 in the paper storage unit 13, a movable platen 17 disposed to rotate freely on the cover 28 for guiding the back of the paper roll P1 to a proximal position opposite the print head 16, and an abutment 35 for engaging the engagement levers 36 of the movable platen 17 and rotating the movable platen 17 in a contrary direction in conjunction with opening and closing the cover 28. It is therefore possible to retract the movable platen 17 together with the cover 28 without interfering with other internal parts of the printer 10 when the cover 28 is opened, and unlike a conventional sliding mechanism used to advance and retract the platen, the configuration of the present invention does not interfere with smooth opening and closing of the cover 28, invite an increase in printer size, or require much space around the printer.

Furthermore, by providing a first movable transportation roller 20 disposed to the free end side of the movable platen 17 for transporting the roll paper between the first movable transportation roller and a first fixed transportation roller 19 disposed inside the printer, the roll paper can be easily aligned to the paper transportation path when the cover 28 is closed.

Yet further, by further providing a second movable transportation roller 22 disposed at the fixed end side of the movable platen 17 for transporting the roll paper between the second movable transportation roller and a second fixed transportation roller 21 disposed inside the printer, roll paper transportation problems can be prevented by transporting the paper with a pair of first and second transportation rollers. In addition, by holding the roll paper with the first and second movable transportation rollers 20, 22 when the cover 28 is closed, appropriate tension can be applied to the roll paper and printing defects caused by slack in the roll paper can be prevented.

Furthermore, because the first movable transportation roller 20 contacts the first fixed transportation roller 19 on the upstream side of the print head 16 after the second movable transportation roller 22 contacts the second fixed transportation roller 21 on the downstream side of the print head 16 when the cover 28 is operated to close, problems such as excessive force acting on the roll paper and the transportation rollers 20, 22 applying pressure to the roll paper while there is slack in the paper can be avoided.

Further preferably, a positioning guide part 37 is disposed on the free end side of the movable platen 17 for guiding the movable platen 17 into position when the cover 28 is operated to close. This accurately positions the movable platen 17 and thus prevents printing defects and transportation problems.

Yet further preferably, the abutment 35 substantially stops rotation of the movable platen 17 near the fully closed position of the cover 28, and engages the positioning guide part 37 with a fixed guide pin 38 on the housing side. The movable platen 17 can thus be positioned accurately.

The guiding direction of the positioning guide part 37 is substantially perpendicular to the direction in which the movable platen 17 escapes from the print head 16. Movement of the movable platen 17 away from the print head 16 is thus reliably restricted by the positioning guide parts 37, and printing defects caused by the movable platen 17 separating from the print head 16 can be prevented.

Furthermore, because the guiding direction of the positioning guide part 37 is substantially perpendicular to a tangent of the first movable transportation roller 20 and the first fixed transportation roller 19, the first movable transportation roller 20 can be accurately positioned with respect to the first fixed transportation roller 19, and paper transportation problems due to an offset in the positions of the transportation rollers 19, 20 can be prevented.

Yet further preferably, a first movable transportation roller 20 is disposed on the free end side of the movable platen 17 for transporting the roll paper between the first movable transportation roller 20 and the first fixed transportation roller 19 disposed inside the printer. The support axis (shaft) 33 of the first movable transportation roller is positioned on the print head side of an imaginary line passing through the center of rotation of the movable platen and the center of rotation of the first fixed transportation roller rotation as seen in a side view. It is therefore possible to press and position the movable platen 17 to the print head 16 using the first fixed transportation roller 19 and first movable transportation roller 20. The number of parts can therefore be reduced and the structure simplified compared with a configuration using special platen presser or platen positioning members.

Yet further preferably, elliptical holes 17*a* (accommodating means) allowing the first movable transportation roller 20 to pass over the first fixed transportation roller 19 in conjunction with opening and closing the cover 28 are provided. This reduces the load of the first movable transportation roller 20 as it moves over the first fixed transportation roller 19, thus avoids deformation of or damage to members when the movable transportation roller rides over the fixed transportation roller, and avoids problems interfering with smooth opening and closing of the cover 28.

The print head 16 can print on roll paper (continuous sheet medium) and single-sheet forms P2 (single sheet medium), and the printer additionally has a diversion unit 18 disposed downstream from the print head on the frame side for diverting the roll paper and single-sheet form P2 to respective paths. The diversion unit 18 can be retracted to a position not interfering with opening and closing the cover. In other words, while the diversion unit 18 for diverting the paper roll P1 and single-sheet form P2 to separate exit paths is disposed downstream of the print head 16, the diversion unit 18 can be automatically retracted when the cover 28 is opened or closed to a position not interfering with opening and closing the cover 28. Interference between the diversion unit 18 and movable platen 17 is therefore reliably avoided, the cover 28 can be smoothly opened, and damage to the diversion unit 18 can be avoided.

Yet further preferably the abutment is positioned near the diversion unit 18. In other words, by disposing the abutment 35 near the diversion unit 18, which is prevented from interfering with the movable platen 17, the movable platen 17 can be made as small as possible and the abutment 35 is prevented from interfering with replacing the paper roll P1.

Furthermore, by disposing the second fixed transportation roller 22 to the diversion unit 18 and transporting the roll paper on the downstream side of the print head 16, slack can be prevented in the roll paper, and the paper can be reliably transported passed the diversion unit. In addition, because the diversion unit 18 is also used as the support member for the second fixed transportation roller 21, the part count can be reduced and the structure can be simplified.

Furthermore, the diversion unit 18 is configured to rotate freely in an advancing-retracting direction relative to the roll paper (continuous sheet medium) transportation path or second movable transportation roller 22, and is urged by a presser spring 43 in the advancing direction. The diversion unit 18 can therefore be smoothly retracted when there is contact with the movable platen 17, and pressure can be applied reliably to the paper due to the urging force of the presser spring 43.

Yet further, because the diversion unit 18 has a fixed knife 41 for cutting the roll paper, the diversion unit 18 is also used as the support member for the fixed knife 41. This further reduces the part count and simplifies the structure.

Further preferably, the printer has a cover release button 31 disposed on the frame side and operated in a straight line, and a cover locking mechanism 44 for locking the cover in a closed position. The cover locking mechanism 44 enables the cover to be opened when the cover release button is operated, and thus enables the diversion unit 18 to move to the retracted side.

The cover locking mechanism 44 has lock pins 30 disposed on the frame side; lock levers 29 rotatably disposed at the frame side for engaging and releasing the lock pins 30;

and a lock release lever 45 rotatably disposed at the frame side. When the cover release button 31 is operated the lock release lever 45 moves the lock levers 29 to disengage and release the lock pins, and move the diversion unit 18 to the retracted side. That is, while the cover release button 31 travels in a straight line it moves the lock levers 29 and diversion unit 18 by way of a pivoting lock release lever 45, thereby reducing the force needed to operate the cover release button 31 and further improving the operability of the cover opening operation.

Yet further preferably, the lock release lever 45 has a first lever part 45*a* linked to the cover release button 31; a second lever part 45*b* linked to the lock levers 29 and the diversion unit 18; and a connecting part 45*c*integrally linking the first and second lever parts 45*a*, 45*b*. The first and second lever parts 45*a*, 45*b* are pivotally supported. This configuration increases lock release lever 45 strength, enables the lock release lever 45 to operate smoothly, and thus further improves the operability of the cover opening operation.

Yet further preferably, a lock release lever support part (lock release lever support member 47 and side frame 46) supporting the lock release lever 45 to pivot freely comprises a rotation support part 47*a* enabling attaching the lock release lever 45 from a lateral direction outside the normal rotation range; and a stop part 46*a* limiting lateral movement of the lock release lever 45 in the normal rotation range. Rotation of the lock release lever 45 to outside the normal rotation range is limited by the cover release button 31. A special member for limiting lateral movement of the lock release lever 45 is thus unnecessary, and the part count and the number of assembly steps reduced can therefore be reduced and the structure can be simplified.

Further preferably, the first lever part 45*a* has a notched part 45*i* contiguous to the pivot hole 45*e*, and the rotation support part 47*a* has a narrow part 47*b* to which the notched part 45*i* fits and a pivot shaft part 47*c* protruding horizontally from the narrow part 47*b*. The pivot hole 45*e* can be fit to the pivot shaft part 47*c* when the notched part 45*i* is fit to the narrow part 47*b*. It is therefore possible to mount the lock release lever 45 to the rotation support part 47*a* using a simple configuration having a notched part 45*i* formed in the lock release lever 45 and a narrow part 47*b* formed to the rotation support part 47*a*.

A preferred embodiment of the present invention has been described above with reference to the accompanying figures, and it will be apparent to one with ordinary skill in the art that the invention can be varied in many ways without departing from the scope of the accompanying claims.

For example, an engagement lever 36 and abutment 35 engaging the engagement lever 36 are disposed on both side ends in the above embodiment, but could be disposed on only one end. Furthermore, the diverter support shaft 42 or the presser spring 43 coupled to the diverter support shaft 42 could alternatively be used as the abutment 35.

Furthermore, the fixed transportation roller is described above as being on the drive side and the movable transportation roller as being on the driven (follower) side, but these could be reversed so that the fixed transportation roller is the driven (follower) side and the movable transportation roller is the drive side.

BENEFITS OF THE INVENTION

A printer according to the present invention can retract the platen and transportation rollers while avoiding interference with internal printer parts when opening the cover, does not obstruct smooth opening and closing of the cover, does not invite an increase in printer size, does not require a wide space around the printer, and can accurately position the movable platen to prevent print defects and paper transportation problems.

Furthermore, while the printer has a diversion unit at a position downstream of the print head for diverting continuous sheet media and single sheet media, the diversion unit is automatically retracted to a position where the diversion unit will not interfere with opening and closing the cover when the cover is opened. The cover can therefore be smoothly opened and closed, and damage to the diversion unit can be prevented. The operability of the cover opening operation is also improved by releasing the cover lock and retracting the diversion unit as a result of a linear operation of the cover release button.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A printer comprising:

a frame having a support base and a cover, said frame further having a storage unit for storing a continuous sheet medium;

wherein said cover is effective for opening and closing an opening to the storage unit;

a print head for printing on the continuous sheet medium pulled from the storage unit;

a platen pivotally supported at a pivot point on the cover and movable between an inoperative and an operative position relative to the cover for guiding, in its operative position, a back surface of the continuous sheet medium at a position opposite the print head; and an abutment fixed to said support base for engaging a rigid end side of the platen and rotating the free end side of the platen about said pivot point in conjunction with opening and dosing of the cover, so as to cause the platen to refract from its operative position in conjunction with a cover opening operation and to advance to the operative position in conjunction with a cover closing operation.

2. A printer as described in claim 1, further comprising a first movable transportation roller disposed at the free end side of the platen for transporting the continuous sheet medium between the first movable transportation roller and a first fixed transportation roller on the frame side.

3. A printer as described in claim 1, further comprising a positioning guide part disposed on the free end side of the platen for positioning and guiding the platen relative to the frame when the cover is operated to close.

4. A printer as described in claim 3, wherein the abutment substantially stops rotation of the platen near the fully closed position of the cover, so as to allow the positioning guide part to engage with a fixed guide part on the frame side.

5. A printer as described in claim 3, wherein the guiding direction of the positioning guide part is substantially perpendicular to the direction in which the platen escapes from the print head when the cover is opened.

6. A printer as described in claim 3, further comprising:

a first movable transportation roller disposed at the free end side of the platen for transporting the continuous sheet medium between the first movable transportation roller and a first fixed transportation roller on the frame side;

wherein the guiding direction of the positioning guide part is substantially perpendicular to a tangential direction of the first, movable transportation roller and the first fixed transportation roller.

7. A printer comprising:

a frame having a storage unit for storing a continuous sheet medium;

a cover for opening and closing an opening to the storage unit;

a print head for printing on the continuous sheet medium pulled from the storage unit;

a platen pivotally supported on the cover and movable between an inoperative and an operative position relative to the cover for guiding, in its operative position, a back surface of the continuous sheet medium at a position opposite the print head;

an abutment for engaging a fixed end side of the platen and rotating the free end side of the platen in conjunction with opening and closing of the cover, the platen retracting from its operative position in conjunction with a cover opening operation, and advancing to the operative position in conjunction with a cover closing operation;

a first movable transportation roller disposed at the free end side of the platen for transporting the continuous sheet medium between the first movable transportation roller and a first fixed transportation roller on the frame side; and a second movable transportation roller disposed at the fixed end side of the platen for transporting the continuous sheet medium between the second movable transportation roller and a second fixed transportation roller disposed on the frame side.

8. A printer as described in claim 7, wherein the first movable transportation roller contacts the first fixed transportation roller on an upstream side of the print head after the second movable transportation roller contacts the second fixed transportation roller on a downstream side of the print head when the cover is operated to close.

9. A printer comprising:

a frame having a storage unit for storing a continuous sheet medium;

a cover for opening and closing an opening to the storage unit;

a print head for printing on the continuous sheet medium pulled from the storage unit;

a platen pivotally supported on the cover and movable between an inoperative and an operative position relative to the cover for guiding, in its operative position, a back surface of the continuous sheet medium at a position opposite the print head;

an abutment for engaging a fixed end side of the platen and rotating the free end side of the platen in conjunction with opening and closing of the cover, the platen retracting from its operative position in conjunction with a cover opening operation, and advancing to the operative position in conjunction with a cover closing operation; and a first movable transportation roller disposed on the free end side of the platen for transporting the continuous sheet medium between the first movable transportation roller and a first fixed transportation roller disposed on the frame side;

wherein the first movable transportation roller, the first fixed transportation roller, and the pivot point are positioned in a triangular arrangement when the cover is closed, with the first fixed transportation roller and the pivot point being the base of the triangular arrangement and the first movable transportation roller being its apex arranged toward the print head.

10. A printer as described in claim 9, further comprising an accommodating means for allowing the first movable transportation roller to pass over the first fixed transportation roller in conjunction with opening and closing the cover.

11. A printer comprising:

a frame having a storage unit for storing a continuous sheet medium;

a cover for opening and closing an opening to the storage unit;

a print head for printing on the continuous sheet medium pulled from the storage unit;

a platen pivotally supported on the cover and movable between an inoperative and an operative position relative to the cover for guiding, in its operative position, a back surface of the continuous sheet medium at a position opposite the print head; and an abutment for engaging a fixed end side of the platen and rotating the free end side of the platen in conjunction with opening and closing of the cover, the platen retracting from its operative position in conjunction with a cover opening operation, and advancing to the operative position in conjunction with a cover closing operation;

wherein the print head can print to said continuous sheet medium and a single sheet medium, the printer further comprising a diversion unit disposed at a position downstream of the print head on the frame side, the diversion unit being effective for routing the continuous sheet medium and single sheet medium along differing paths and being retractable to a position not interfering with the opening and closing of the cover.

12. A printer as described in claim 11, wherein the abutment is positioned near the diversion unit.

13. A printer as described in claim 11, wherein a second fixed transportation roller is coupled to the diversion unit.

14. A printer as described in claim 11, wherein the diversion unit is configured to rotate freely in an advancing retracting direction relative to the continuous sheet medium transportation path or second movable transportation roller, and is urged by a presser spring in the advancing direction.

15. A printer as described in claim 11, further comprising a cover release button disposed on the frame side and operated in a linear direction; and a cover locking mechanism for locking the cover in a dosed position, enabling a cover opening operation and moving the diversion unit to the retracted side in conjunction with operation of the cover release button.

16. A printer as described in claim 15, wherein the cover locking mechanism comprises:

a lock pin disposed on the frame side;

a lock lever rotatably coupled to the frame side for engaging and releasing the lock pin; and a lock release lever rotatably coupled to the frame side for operating the lock lever to a release lock side and operating the diversion unit to the retracted side in conjunction with operation of the cover release button.

17. A printer as described in claim 16, wherein the lock release lever comprises a first lever part engageable by the cover release button;

a second lever part adapted to engage the lock lever and the diversion unit; and a connecting part integrally linking the first and second lever parts, the first and second lever parts being rotatably supported.

18. A printer as described in claim 17, wherein the first or second lever part comprises a notch part communicating with a pivot hole;

the rotation support pert comprising a narrow part to which the notch part can be fit; and a pivot shaft part protruding laterally from the narrow part and permitting fitting with the pivot hole when the notch part is fit to the narrow part.

19. A printer as described in claim 16, wherein a lock release lever support part freely rotatably supporting the lock release lever comprises:

a rotation support part enabling attaching the lock release lever from a lateral direction outside the normal rotation range; and a stop part limiting lateral movement of the lock release lever in the normal rotation range; wherein rotation of the lock release lever to outside the normal rotation range is limited by the cover release button.

20. A printer comprising:

a frame having a storage unit for storing a continuous sheet medium;

a cover for opening and closing an opening to the storage unit;

a print head for printing on the continuous sheet medium pulled from the storage unit;

a platen pivotally supported on the cover and movable between an inoperative and an operative position relative to the cover for guiding, in its operative position, a back surface of the continuous sheet medium at a position opposite the print head; and an abutment for engaging a fixed end side of the platen and rotating the free end side of the platen in conjunction with opening and closing of the cover, the platen retracting from its operative position in conjunction with a cover opening operation, and advancing to the operative position in conjunction with a cover closing operation;

wherein the print head can print to said continuous sheet medium and a single sheet medium the printer further comprising a diversion unit disposed at a position downstream of the print head on the frame side, the diversion unit routing the continuous sheet medium and single sheet medium and being retractable to a position not interfering with the open-mg and closing of the cover; and wherein the diversion unit comprises a fixed knife for cutting the continuous sheet medium.

* * * * *

UNITED STATES PATENT AND TRADEMARK OFFICE

CERTIFICATE OF CORRECTION

PATENT NO. : 6,789,969 B2
DATED : September 14, 2004
INVENTOR(S) : Kenichi Hirabayashi et al.

It is certified that error appears in the above-identified patent and that said Letters Patent is hereby corrected as shown below:

Column 19,
Line 7, please change “pert” to -- part --.

Column 20,
Line 22, please change “open-mg” to -- opening --.

Signed and Sealed this

Eighth Day of February, 2005

JON W. DUDAS
*Director of the United States Patent and Trademark Office*

UNITED STATES PATENT AND TRADEMARK OFFICE

CERTIFICATE OF CORRECTION

PATENT NO. : 6,789,969 B2
APPLICATION NO. : 10/178446
DATED : September 14, 2004
INVENTOR(S) : Kenichi Hirabayashi et al.

It is certified that error appears in the above-identified patent and that said Letters Patent is hereby corrected as shown below:

Column 16, line 41,
Change "dosing" to --closing-- and

Column 16, line 42,
Change "refract" to --retract--.

Signed and Sealed this
Twelfth Day of February, 2013

Teresa Stanek Rea
*Acting Director of the United States Patent and Trademark Office*